US011189924B2

(12) United States Patent
Lee et al.

(10) Patent No.: US 11,189,924 B2
(45) Date of Patent: Nov. 30, 2021

(54) ANTENNA STRUCTURE

(71) Applicant: Chiun Mai Communication Systems, Inc., New Taipei (TW)

(72) Inventors: Cheng-Han Lee, New Taipei (TW); Min-Hui Ho, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 455 days.

(21) Appl. No.: 16/217,065

(22) Filed: Dec. 12, 2018

(65) Prior Publication Data

US 2019/0181553 A1 Jun. 13, 2019

Related U.S. Application Data

(60) Provisional application No. 62/597,442, filed on Dec. 12, 2017, provisional application No. 62/614,364, filed on Jan. 6, 2018.

(51) Int. Cl.

| | |
|---|---|
| ***H01Q 1/24*** | (2006.01) |
| ***H01Q 5/35*** | (2015.01) |
| ***H01Q 9/28*** | (2006.01) |
| ***H01Q 3/24*** | (2006.01) |
| ***H01Q 9/42*** | (2006.01) |
| ***H01Q 5/335*** | (2015.01) |
| ***H01Q 21/28*** | (2006.01) |
| ***H01Q 13/10*** | (2006.01) |
| ***H01Q 9/30*** | (2006.01) |

(52) U.S. Cl.

CPC ..... *H01Q 5/35* (2015.01); *H01Q 1/243* (2013.01); *H01Q 3/247* (2013.01); *H01Q 5/335* (2015.01); *H01Q 9/285* (2013.01); *H01Q 9/30* (2013.01); *H01Q 9/42* (2013.01); *H01Q 13/10* (2013.01); *H01Q 21/28* (2013.01)

(58) Field of Classification Search

None

See application file for complete search history.

(56) References Cited

U.S. PATENT DOCUMENTS

| | | | | |
|---|---|---|---|---|
| 9,559,433 | B2 * | 1/2017 | Zhou | H01Q 1/243 |
| 9,806,400 | B2 | 10/2017 | Tseng et al. | |
| 10,886,614 | B2 * | 1/2021 | Lee | H01Q 13/10 |

(Continued)

FOREIGN PATENT DOCUMENTS

| | | | |
|---|---|---|---|
| CN | 104064879 | A | 9/2014 |
| CN | 104752822 | A | 7/2015 |

(Continued)

OTHER PUBLICATIONS

CN107317095A and English translation, 13 pages, no date.*

*Primary Examiner* — Trinh V Dinh

(74) *Attorney, Agent, or Firm* — ScienBiziP, P.C.

(57) ABSTRACT

An antenna structure includes a housing, a first feed source, a second feed source, a third feed source, and a radiating body. The first feed source is electrically coupled to a first radiating portion of the housing and adapted to provide an electric current to the first radiating portion. The second feed source is electrically coupled to the second radiating portion and adapted to provide an electric current to the second radiating portion. The radiating body is mounted within the housing and electrically coupled to the third feed source. The third feed source provides an electric current to the radiating body.

20 Claims, 23 Drawing Sheets

(56) References Cited

U.S. PATENT DOCUMENTS

| | | | | |
|---|---|---|---|---|
| 2012/0009983 | A1* | 1/2012 | Mow | H04B 1/40 455/575.7 |
| 2014/0266923 | A1 | 9/2014 | Zhou et al. | |
| 2015/0372372 | A1 | 12/2015 | Lee et al. | |
| 2018/0026348 | A1* | 1/2018 | Lee | H01Q 1/44 455/575.5 |
| 2018/0026360 | A1* | 1/2018 | Lee | H01Q 5/371 343/872 |
| 2018/0248264 | A1* | 8/2018 | Chen | H01Q 9/40 |
| 2018/0358699 | A1* | 12/2018 | Li | H01Q 11/14 |
| 2019/0036210 | A1* | 1/2019 | Kim | G06F 1/203 |
| 2020/0076059 | A1* | 3/2020 | Hsiao | H01Q 9/42 |

FOREIGN PATENT DOCUMENTS

| | | | | |
|---|---|---|---|---|
| CN | 205960191 | U | | 2/2017 |
| CN | 107317095 | A | * | 11/2017 |
| CN | 107317095 | A | | 11/2017 |

* cited by examiner

ANTENNA STRUCTURE

FIELD

The subject matter herein generally relates to antenna structures, and more particularly to an antenna structure of a wireless communication device.

BACKGROUND

As electronic devices become smaller, an antenna structure for operating in different communication bands is required to be smaller. The present disclosure discloses an antenna covers multiple communication bandwidths.

BRIEF DESCRIPTION OF THE DRAWINGS

Implementations of the present disclosure will now be described, by way of embodiments only, with reference to the attached figures.

DETAILED DESCRIPTION

Figure 1:
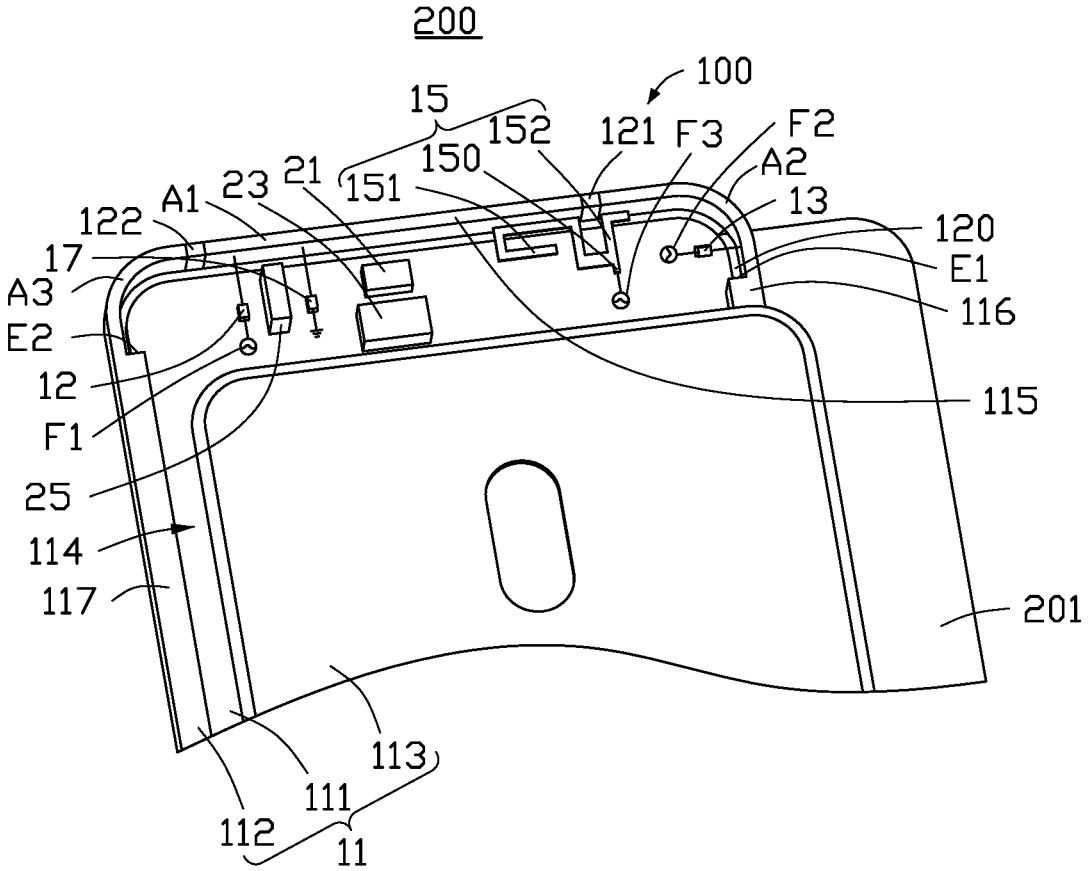
FIG. 1 is a partial isometric view of an embodiment of an antenna structure in a wireless communication device.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series and the like.

Figure 2:
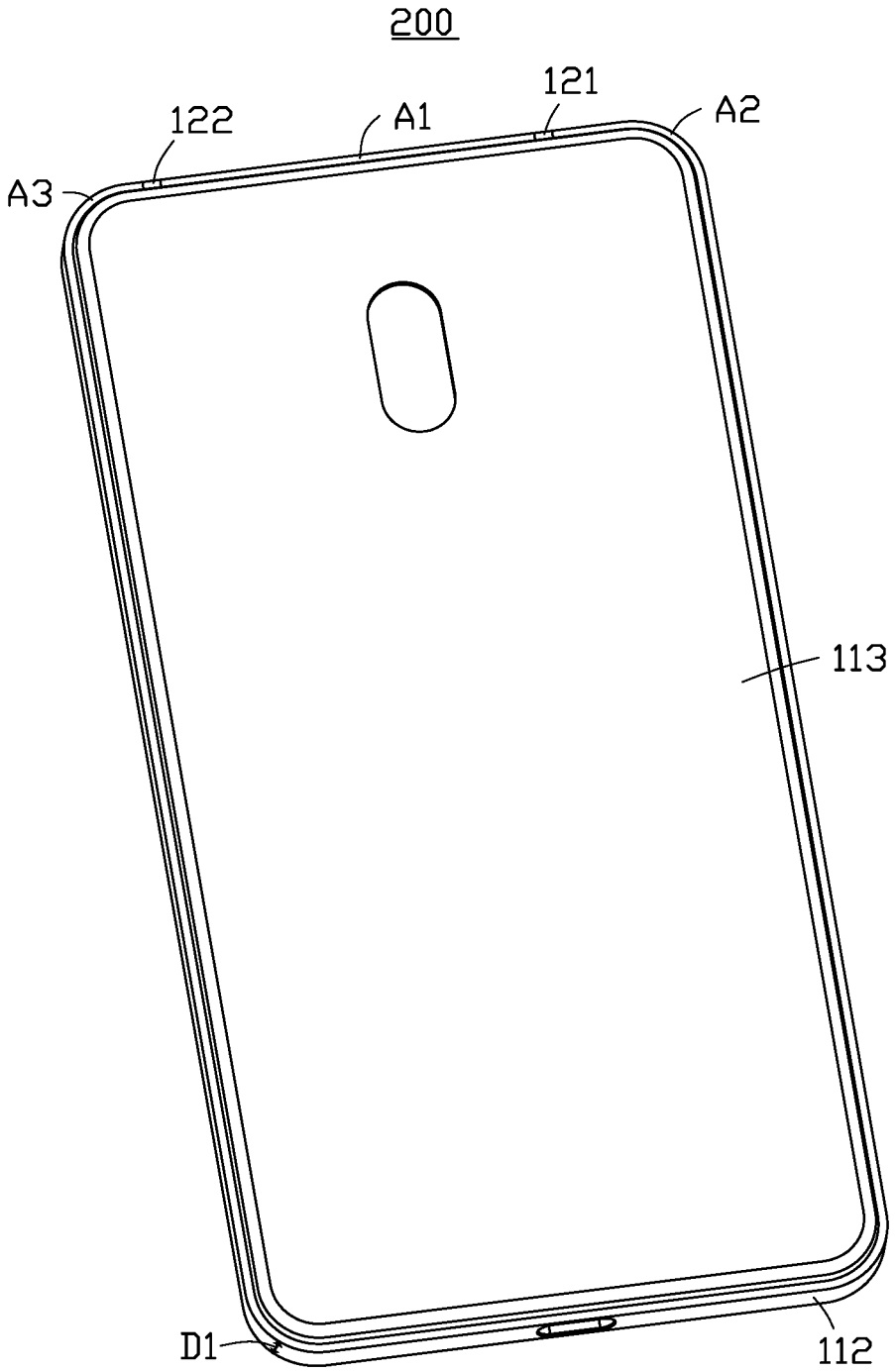
FIG. 2 is an isometric view of the communication device in FIG. 1.

FIG. 1 and FIG. 2 show an embodiment of an antenna structure 100 applicable in a mobile phone, a personal digital assistant, or other wireless communication device 200 for sending and receiving wireless signals.

As shown in FIG. 1, the antenna structure 100 includes a housing 11, a first feed source F1, a first matching circuit 12, a second feed source F2, a second matching circuit 13, a radiating body 15, and a third feed source F3.

The housing 11 includes at least a middle frame 111, a border frame 112, and a backplane 113. The middle frame 111 is substantially rectangular. The middle frame 111 is made of metal. The border frame 112 is substantially hollow rectangular and is made of metal. In one embodiment, the border frame 112 is mounted around a periphery of the middle frame 111 and is integrally formed with the middle frame 111. The border frame 112 receives a display 201 mounted opposite the middle frame 111.

The middle frame 111 is a metal plate mounted between the display 201 and the backplane 113. The middle frame 111 supports the display 201, provides electromagnetic shielding, and enhances durability of the wireless communication device 200.

The backplane 113 is made of insulating material, such as glass. The backplane 113 is mounted around a periphery of the border frame 112 and is substantially parallel to the display 201 and the middle frame 111. In one embodiment, the backplane 113, the border frame 112, and the middle frame 111 cooperatively define an accommodating space 114. The accommodating space 114 receives components (not shown) of the wireless communication device 200.

The border frame 112 includes at least an end portion 115, a first side portion 116, and a second side portion 117. In one embodiment, the end portion 115 is a top end of the wireless communication device 200. The first side portion 116 and the second side portion 117 face each other and are substantially perpendicular to the end portion 115.

In one embodiment, the border frame 112 includes a slot 120, a first gap 121, and a second gap 122. The slot 120 is substantially U-shaped and is defined in an inner side of the end portion 115. In one embodiment, the slot 120 extends along the end portion 115 and extends toward the first side portion 116 and the second side portion 117. The slot 120 insulates the end portion 115 from the middle frame 111.

In one embodiment, the first gap 121 and the second gap 122 are located on the end portion 115. The first gap 121 and the second gap 122 cut across and cut through the end portion 115. The slot 120, the first gap 121, and the second gap 122 separate the housing 11 into a first radiating portion A1, a second radiating portion A2, and a third radiating portion A3. In one embodiment, the first radiating portion A1 is a portion of the border frame 112 located between the first gap 121 and the second gap 122. The second radiating portion A2 is a portion of the border frame 112 located between the first gap 121 and a first endpoint E1 of the first side portion 116. The third radiating portion A3 is a portion of the border frame 112 located between the second gap 122 and a second endpoint E2 of the second side portion 117.

In one embodiment, the first radiating portion A1 is insulated from the middle frame 111 by the slot 120. An end of the second radiating portion A2 adjacent the first endpoint E1 and an end of the third radiating portion A3 adjacent the second endpoint E2 are coupled to the middle frame 111. The second radiating portion A2, the third radiating portion A3, and the middle frame 111 cooperatively form an integrally formed metal frame.

Figure 3:
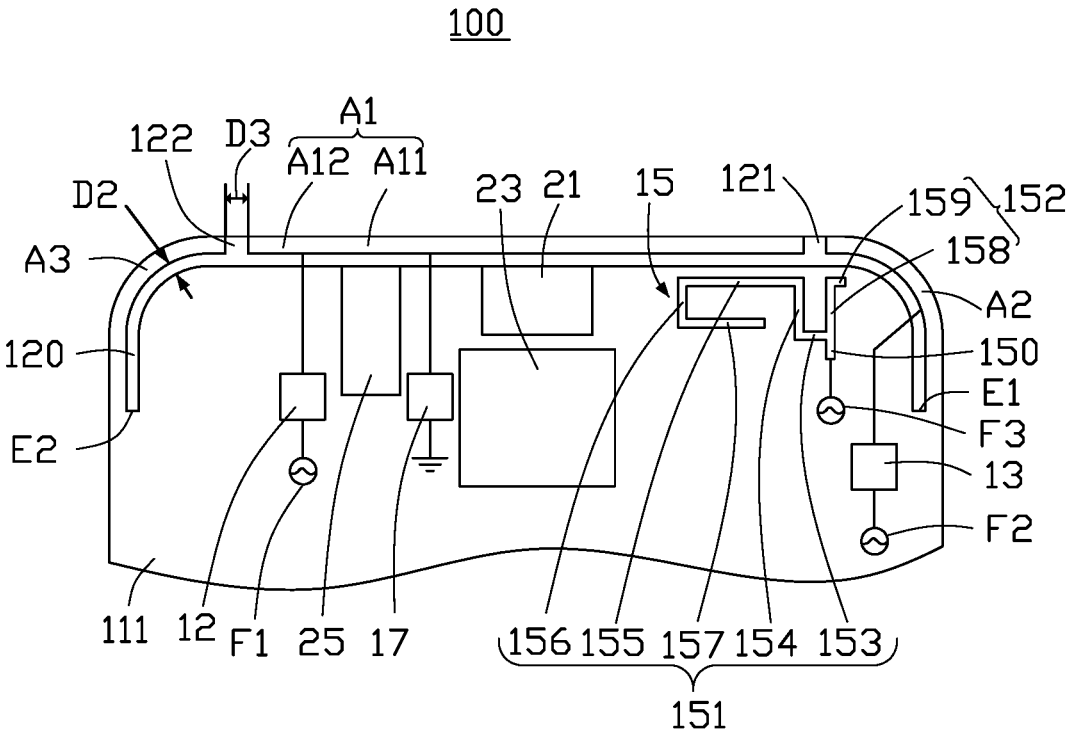
FIG. 3 is a diagram of the antenna structure in FIG. 1.

In one embodiment, the border frame 112 has a thickness D1. The slot 120 has a width D2 (FIG. 3). The first gap 121 and the second gap 122 have a width D3. D1 is greater than or equal to 2*D3. D2 is less than or equal to half of D3. In one embodiment, the thickness D1 of the border frame 112 is 3-8 mm. The width D2 of the slot 120 is 0.5-1.5 mm.

In one embodiment, the slot 120, the first gap 121, and the second gap 122 are made of insulating material, such as plastic, rubber, glass, wood, ceramic, or the like.

The wireless communication device 200 further includes at least one electronic component, such as a first electronic component 21, a second electronic component 23, and a third electronic component 25. The first electronic component 21 may be a proximity sensor located within the accommodating space 114. The first electronic component 21 is insulated from the first radiating portion A1 by the slot 120.

The second electronic component 23 may be a front camera located within the accommodating space 114. The second electronic component 23 is mounted on a side of the first electronic component 21 away from the first radiating portion A1. The second electronic component 23 is insulated from the first radiating portion A1 by the slot 120. The third electronic component 25 is a microphone and is mounted within the accommodating space 114. The third electronic component 25 is located between the first electronic component 21 and the second electronic component 23 and the second gap 122. In one embodiment, the third electronic component 25 is insulated from the first radiating portion A1 by the slot 120.

In one embodiment, the first feed source F1 and the first matching circuit 12 are mounted within the accommodating space 114. One end of the first feed source F1 is electrically coupled to a side of the first radiating portion A1 adjacent to the second gap 122 through the first matching circuit 12 for feeding a current signal to the first radiating portion A1. The first matching circuit 12 provides a matching impedance between the first feed source F1 and the first radiating portion A1.

In one embodiment, the first feed source F1 divides the first radiating portion A1 into a first radiating section A11 and a second radiating section A12. A portion of the border frame 112 between the first feed source F1 and the first gap 121 is the first radiating section A11. A portion of the border frame 112 between the first feed source F1 and the second gap 122 is the second radiating section A12. In one embodiment, the first feed source F1 is not positioned in the middle of the first radiating portion A1. Thus, a length of the first radiating section A11 may be greater than a length of the second radiating section A12.

The second feed source F2 and the second matching circuit 13 are mounted within the accommodating space 114. One end of the second feed source F2 is electrically coupled to a portion of the second radiating portion A2 adjacent to the first endpoint E1 through the second matching circuit 13 for feeding current signals to the second radiating portion A2. The second matching circuit 13 provides a matching impedance between the second feed source F2 and the second radiating portion A2.

In one embodiment, the radiating body 15 is mounted within the accommodating space 114 and corresponds to the first gap 121. The radiating body 15 has a bent shape and may be a flexible printed circuit board or a laser direct structuring board. The radiating body 15 includes a connecting portion 150, a first branch 151, and a second branch 152. The connecting portion 150 is substantially strip-shaped and extends parallel to the first side portion 116 and extends toward the first gap 121. The first branch 151 has a bent shape and includes a first extending section 153, a second extending section 154, a third extending section 155, a fourth extending section 156, and a fifth extending section 157 coupled in sequence.

The first extending section 153 is substantially strip-shaped. One end of the first extending section 153 is perpendicularly coupled to an end portion of the connecting portion 150, and the first extending section 153 extends parallel to the end portion 115 and extends toward the second side portion 117.

The second extending section 154 is substantially strip-shaped. One end of the second extending section 154 is perpendicularly coupled to an end of the first extending section 153 away from the connecting portion 150, and the second extending section 154 extends parallel to the first side portion 116 and extends toward the end portion 115.

The third extending section 155 is substantially strip-shaped. One end of the third extending section 155 is perpendicularly coupled to an end of the second extending section 154 away from the first extending section 153, and the third extending section 155 extends parallel to the first extending section 153 and extends toward the second side portion 117.

The fourth extending section 156 is substantially strip-shaped. One end of the fourth extending section 156 is perpendicularly coupled to an end of the third extending section 155 away from the second extending section 154, and the fourth extending section 156 extends parallel to the second extending section 154 and extends away from the end portion 115.

The fifth extending section 157 is substantially strip-shaped. One end of the fifth extending section 157 is perpendicularly coupled to an end of the fourth extending section 156 away from the third extending section 155, and the fifth extending section 157 extends parallel to the first extending section 153 and extends toward the second extending section 154.

In one embodiment, the connecting portion 150 is mounted on a same surface as the first extending portion 153, the second extending portion 154, the third extending portion 155, the fourth extending portion 156, and the fifth extending portion 157. A length of the second extending section 154 is longer than a length of the fourth extending section 156. The second extending section 154 and the fourth extending section 156 are mounted on a same side of the third extending section 155 and cooperatively form a U shape with the third extending section 155. The third extending section 155 and the fifth extending section 157 are mounted on a same side of the fourth extending section 156 and cooperatively form a U shape with the fourth extending section 156. A length of the first extending section 153 is less than a length of the fifth extending section 157. The first extending section 153 and the third extending section 155 are mounted on respective opposite sides of the second extending section 154 and extend in opposite directions.

The second branch 152 is substantially L-shaped and includes a first connecting section 158 and a second connecting section 159.

The first connecting section 158 is substantially strip-shaped. One end of the first connecting section 158 is coupled to a junction of the connecting portion 150 and the first extending section 153, and the first connecting section 158 extends parallel to the second extending section 159 and extends toward the end portion 115.

The second connecting section 159 is substantially strip-shaped. One end of the second connecting section 159 is coupled to an end of the first extending section 158 away from the first extending section 153, and the second connecting section 159 extends parallel to the first extending section 153 and extends away from the third extending section 155.

In one embodiment, a length of the first connecting section 158 is the same as a length of the second extending section 154. The first connecting section 158 and the second extending section 154 are mounted on a same side of the first extending section 153 and cooperatively form a U shape with the first extending section 153. An opening of the U shape formed by the first connecting section 158, the second extending section 154, and the first extending section 153 faces the first gap 121. A length of the second connecting section 159 is less than a length of the first extending section 153.

In one embodiment, the third feed source F3 is mounted in the accommodating space 114. The third feed source F3 is electrically coupled to the connecting portion 150 for feeding current signals to the connecting portion 150, the first branch 151, and the second branch 152.

Figure 4:
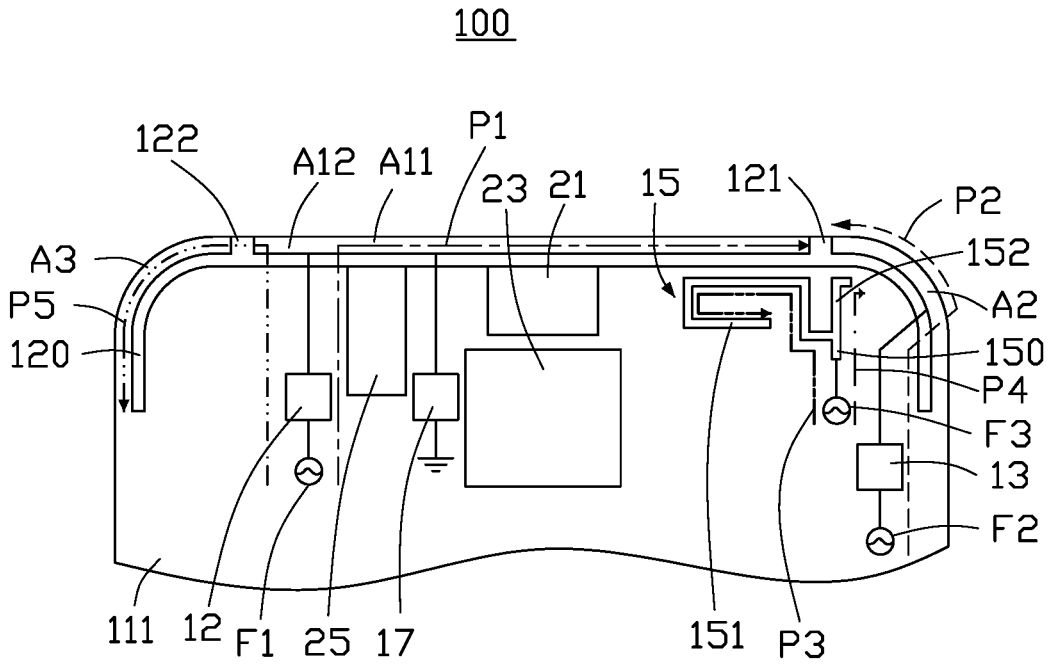
FIG. 4 is a diagram of current paths of the antenna structure in FIG. 3.

As shown in FIG. 4, in one embodiment, the first radiating portion A1 is a monopole antenna, the second radiating portion A2 is a planar inverted F-shaped antenna (PIFA), and the radiating body 15 is a PIFA antenna. When the first feed source F1 supplies electric current, the electric current from the first feed source F1 flows through the first matching circuit 12 and the first radiating section A11 in sequence toward the first gap 121 along a current path P1, thereby activating a first resonant mode and generating a radiation signal in a first frequency band.

When the second feed source F2 supplies electric current, the electric current from the second feed source F2 flows through the second matching circuit 13 and the second radiating portion A2 toward the first gap 121 along a current path P2, thereby activating a second resonant mode and generating a radiation signal in a second frequency band.

When the third feed source F3 supplies electric current, the electric current from the third feed source F3 flows through the connecting portion 150 and the first extending section 153, the second extending section 154, the third extending section 155, the fourth extending section 156, and the fifth extending section 157 of the first branch 151 along a current path P3, thereby activating a third resonant mode and generating a radiation signal in a third frequency band. Simultaneously, electric current from the third feed source F3 flows through the connecting portion 150 and the first connecting section 158 and the second connecting section 159 of the second branch 152 along a current path P4, thereby activating a fourth resonant mode and generating a radiation signal in a fourth frequency band.

Electric current from the first feed source F1 can also flow through the first matching circuit 12 and the second radiating section A12, and then couple to the third radiating portion A3 through the second gap 122 along a current path P5. Thus, the first feed source F1, the second radiating section A12, and the third radiating portion A3 cooperatively form a coupled feed antenna and active a fifth resonant mode and generate a radiation signal in a fifth frequency band.

In one embodiment, the first resonant mode is a Long Term Evolution Advanced (LTE-A) low-frequency mode, the second resonant mode is a GPS frequency mode, the third resonant mode is a WIFI 2.4 GHz frequency mode, the fourth resonant mode is a WIFI 5 GHz frequency mode, and the fifth resonant mode is an LTE-A mid-high-frequency mode. The first frequency band is 700-960 MHz. The second frequency band is 1575 MHz. The third frequency band is 2400-2484 MHz. The fourth frequency band is 5150-5850 MHz. The fifth frequency band is 1450-3000 MHz.

The first feed source F1, the first radiating portion A1, and the third radiating portion A3 cooperatively form a diversity antenna. The second feed source F2 and the second radiating portion A2 cooperatively form a GPS antenna. The third feed source F3 and the radiating body 15 cooperatively form a WIFI 2.4 GHz antenna and a WIFI 5 GHz antenna.

Figure 5:
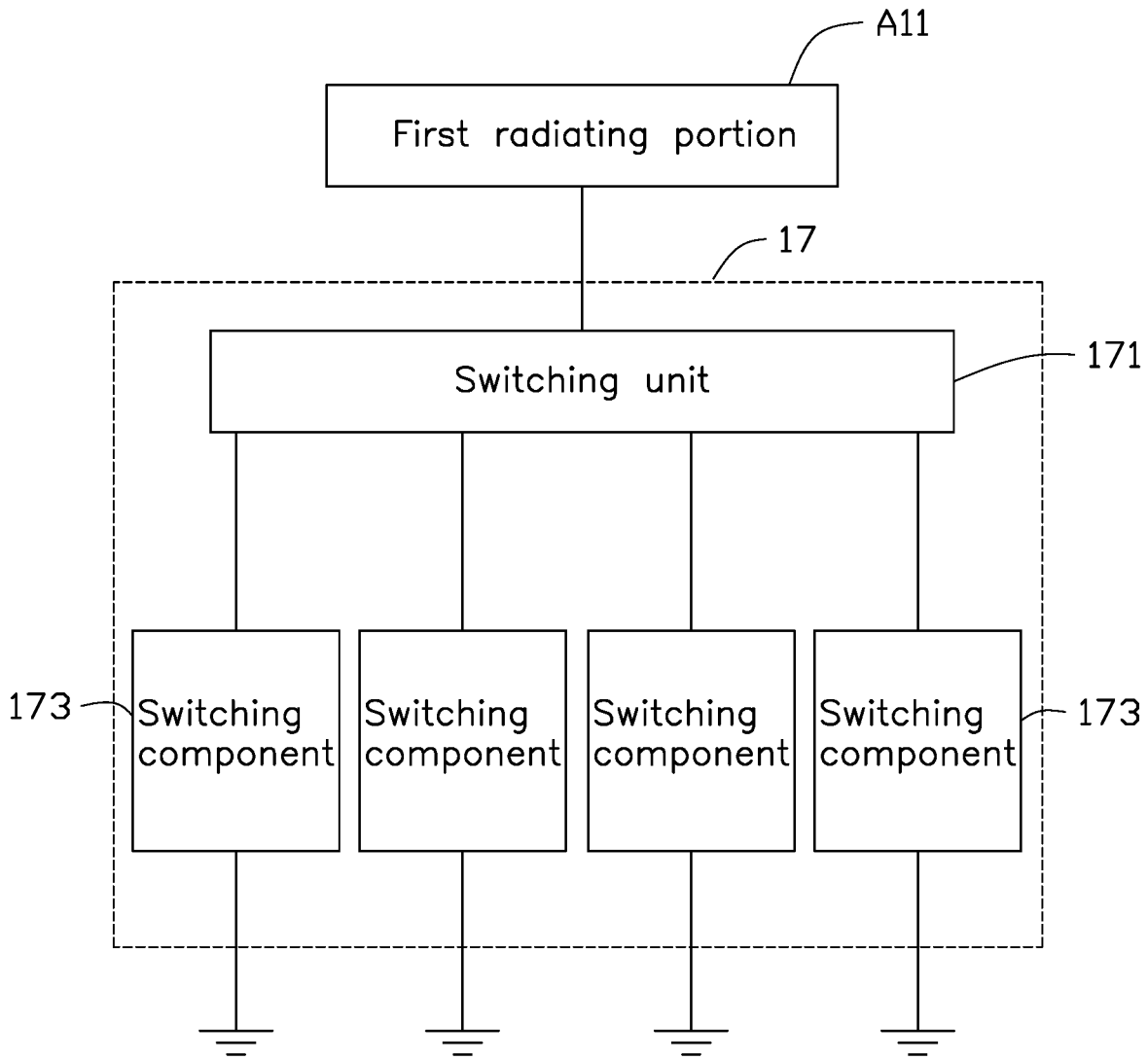
FIG. 5 is a block diagram of a switching circuit.

As shown in FIGS. 2 and 5, in one embodiment, the antenna structure 100 further includes a switching circuit 17. The switching circuit 17 is mounted in the accommodating space 114 between the first electronic component 21 and the third electronic component 25. One end of the switching circuit 17 crosses over the slot 120 and is electrically coupled to the first radiating section A11. A second end of the switching circuit 17 is coupled to ground. The switching circuit 17 includes a switching unit 171 and a plurality of switching components 173. The switching unit 171 is electrically coupled to the first radiating section A11. The switching component 173 may be an inductor, a capacitor, or a combination of the two. The switching components 173 are coupled together in parallel. One end of each of the switching components 173 is electrically coupled to the switching unit 171, and a second end is coupled to ground.

The first radiating section A11 is switched by the switching unit 171 to electrically couple to each of the switching components 173. Since each of the switching components 173 has a different impedance, the switching components 173 can be switched to adjust the LTE-A low-frequency mode. For example, the switching circuit 17 includes four different switching components 173. The four different switching components 173 are switched to couple to the first radiating section A11 to achieve different LTE-A low-frequency modes, such as LTE-A Band17 (704-746 MHz), LTE-A Band13 (746-787 MHz), LTE-A Band 20 (791-862 MHz), and LTE-A Band8 (880-960 MHz).

In one embodiment, a length of the second radiating portion A2 and a length of the third radiating portion A3 are 1-10 mm. The lengths of the second radiating portion A2 and the third radiating portion A3 enhance radiation efficiency of the antenna structure 100.

Figure 6:
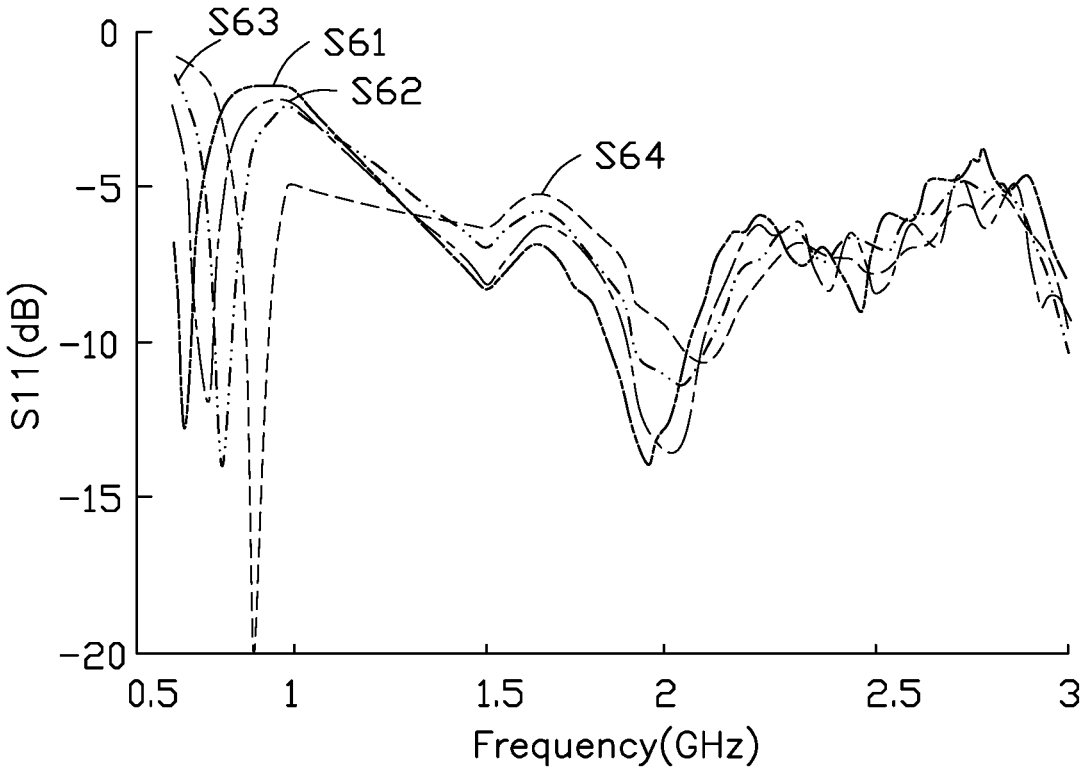
FIG. 6 is a graph of scattering values (S11 values) of the LTE-A low-frequency mode.

FIG. 6 shows a graph of scattering values (S11 values) of the LTE-A low-frequency mode. A plotline S61 represents S11 values of LTE-A Band17 (704-746 MHz). A plotline S62 represents S11 values of LTE-A Band13 (746-787

MHz). A plotline S63 represents S11 values of LTE-A Band20 (791-862 MHz). A plotline S64 represents S11 values of LTE-A Band8 (880-960 MHz).

Figure 7:
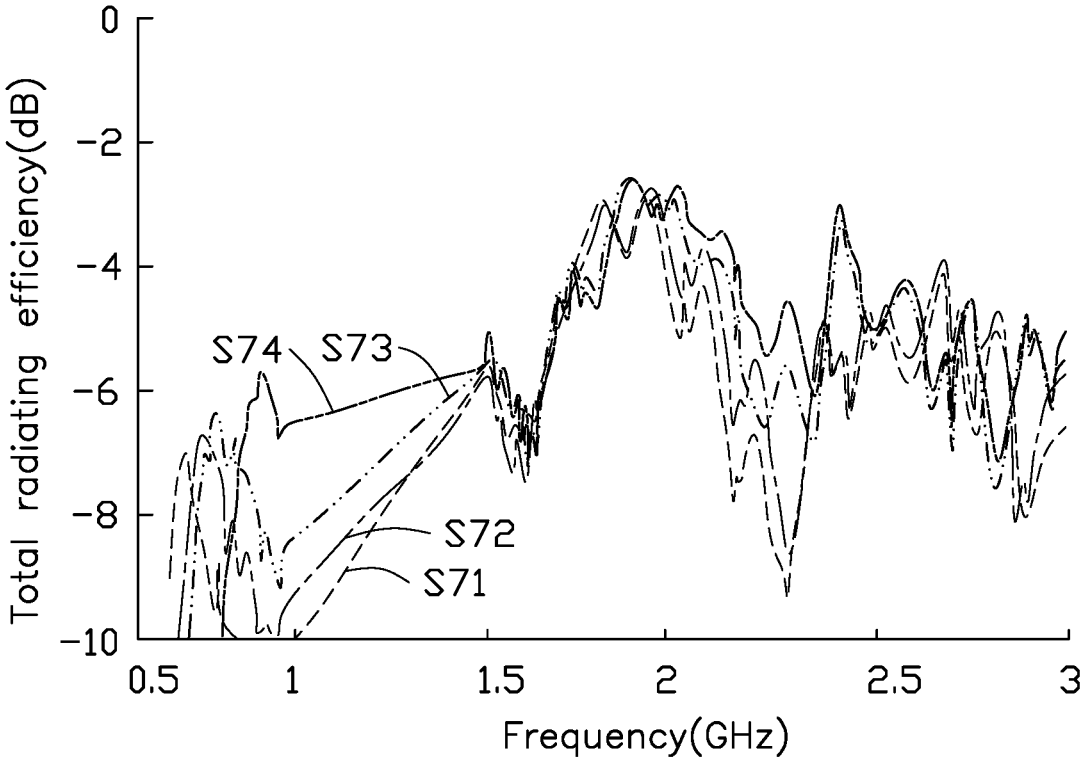
FIG. 7 is a graph of total radiation efficiency of the LTE-A low-frequency, mid-frequency, and high-frequency modes.

FIG. 7 shows a graph of total radiation efficiency of the LTE-A low-frequency, mid-frequency, and high-frequency modes. A plotline S71 represents total radiation efficiency when the antenna structure 100 operates in LTE-A Band17 (704-746 MHz) and the LTE-A mid-high-frequency mode. A plotline S72 represents total radiation efficiency when the antenna structure 100 operates in LTE-A Band13 (746-787 MHz) and the LTE-A mid-high-frequency mode. A plotline S73 represents total radiation efficiency when the antenna structure 100 operates in LTE-A Band20 (791-862 MHz) and the LTE-A mid-high-frequency mode. A plotline S74 represents total radiation efficiency when the antenna structure 100 operates in LTE-A Band8 (880-960 MHz) and the LTE-A mid-high-frequency mode.

As shown in FIGS. 6 and 7, when the antenna structure 100 operates in LTE-A Band17 (704-746 MHz), LTE-A Band13 (746-787 MHz), LTE-A Band20 (791-862 MHz), or LTE-A Band8 (880-960 MHz), the bandwidth range of the antenna structure 100 operating in the mid-high-frequency mode is 1450-3000 MHz. Thus, the switching circuit 17 only adjusts the low-frequency modes and does not affect the mid and high-frequency modes to achieve carrier aggregation requirements of LTE-A.

Figure 8:
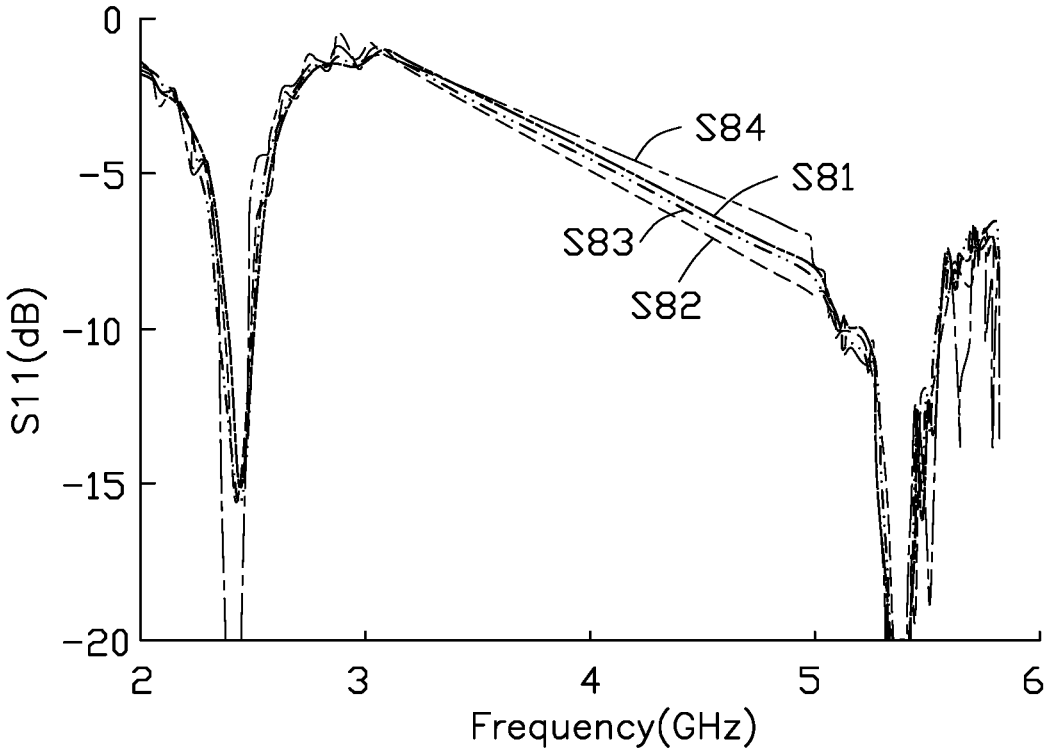
FIG. 8 is a graph of S11 values of the WIFI 2.4 GHz and the WIFI 5 GHz frequency modes.

FIG. 8 shows a graph of S11 values of the WIFI 2.4 GHz and the WIFI 5 GHz frequency modes. A plotline S81 represents S11 values of the WIFI 2.4 GHz and the WIFI 5 GHz bands when the antenna structure 100 operates at LTE-A Band17 (704-746 MHz). A plotline S82 represents S11 values of the WIFI 2.4 GHz and the WIFI 5 GHz bands when the antenna structure 100 operates at LTE-A Band13 (746-787 MHz). A plotline S83 represents S11 values of the WIFI 2.4 GHz and the WIFI 5 GHz bands when the antenna structure 100 operates at LTE-A Band20 (791-862 MHz). A plotline S84 represents S11 values of the WIFI 2.4 GHz and the WIFI 5 GHz bands when the antenna structure 100 operates at LTE-A Band8 (880-960 MHz).

Figure 9:
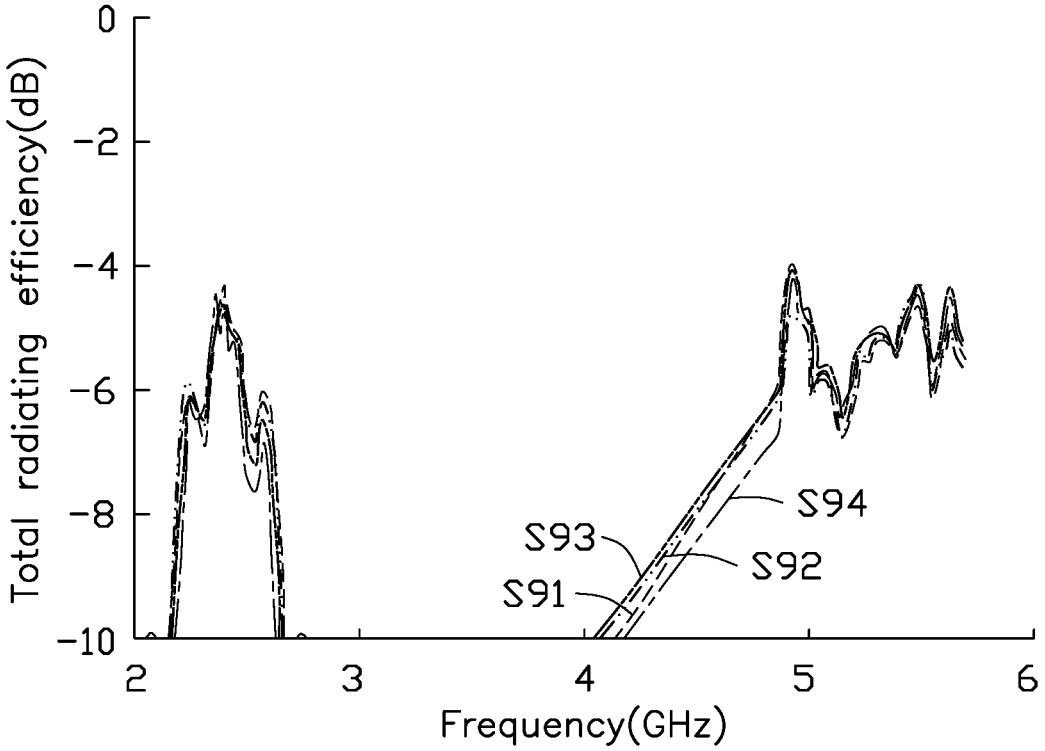
FIG. 9 is a graph of total radiation efficiency of the WIFI 2.4 GHz and the WIFI 5 GHz frequency modes.

FIG. 9 shows a graph of total radiation efficiency of the WIFI 2.4 GHz and the WIFI 5 GHz frequency modes. A plotline S91 represents total radiation efficiency of the WIFI 2.4 GHz and the WIFI 5 GHz bands when the antenna structure 100 operates at LTE-A Band17 (704-746 MHz). A plotline S92 represents total radiation efficiency of the WIFI 2.4 GHz and the WIFI 5 GHz bands when the antenna structure 100 operates at LTE-A Band13 (746-787 MHz). A plotline S93 represents total radiation efficiency of the WIFI 2.4 GHz and the WIFI 5 GHz bands when the antenna structure 100 operates at LTE-A Band20 (791-862 MHz). A plotline S94 represents total radiation efficiency of the WIFI 2.4 GHz and the WIFI 5 GHz bands when the antenna structure 100 operates at LTE-A Band8 (880-960 MHz).

Figure 10:
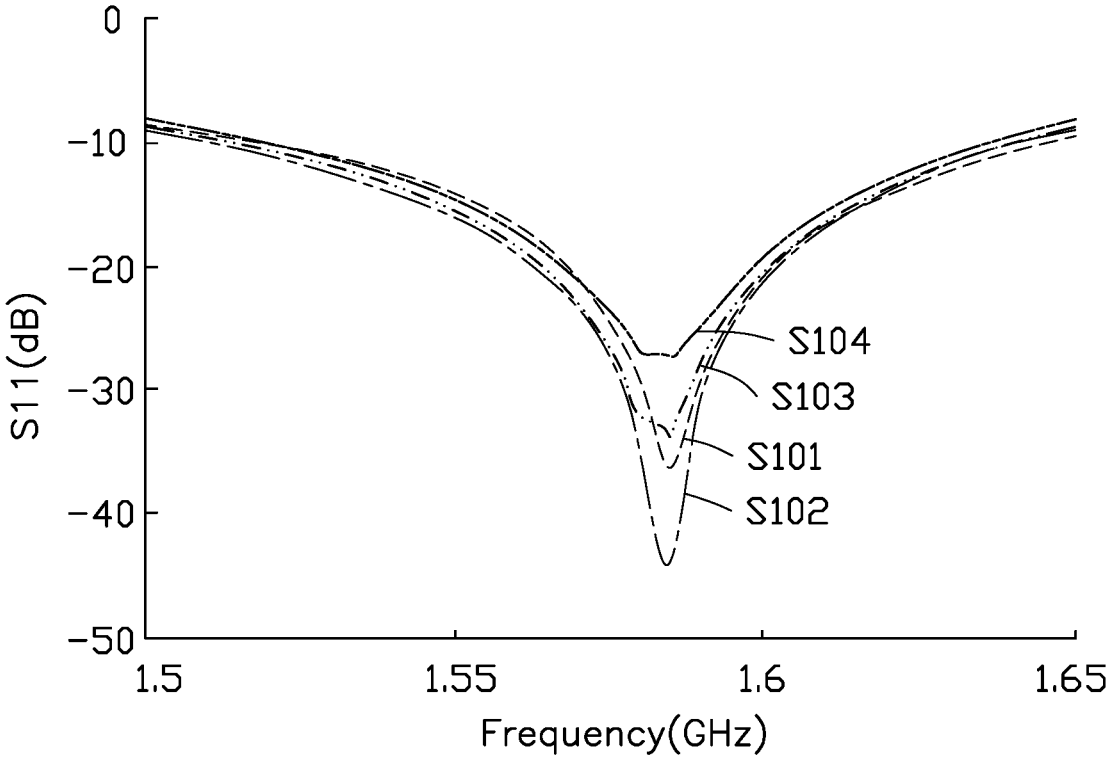
FIG. 10 is a graph of S11 values of the GPS frequency mode.

FIG. 10 shows a graph of S11 values of the GPS frequency mode. A plotline S101 represents S11 values of the GPS band when the antenna structure 100 operates at LTE-A Band17 (704-746 MHz). A plotline S102 represents S11 values of the GPS band when the antenna structure 100 operates at LTE-A Band13 (746-787 MHz). A plotline S103 represents S11 values of the GPS band when the antenna structure 100 operates at LTE-A Band20 (791-862 MHz). A plotline S104 represents S11 values of the GPS band when the antenna structure 100 operates at LTE-A Band8 (880-960 MHz).

Figure 11:
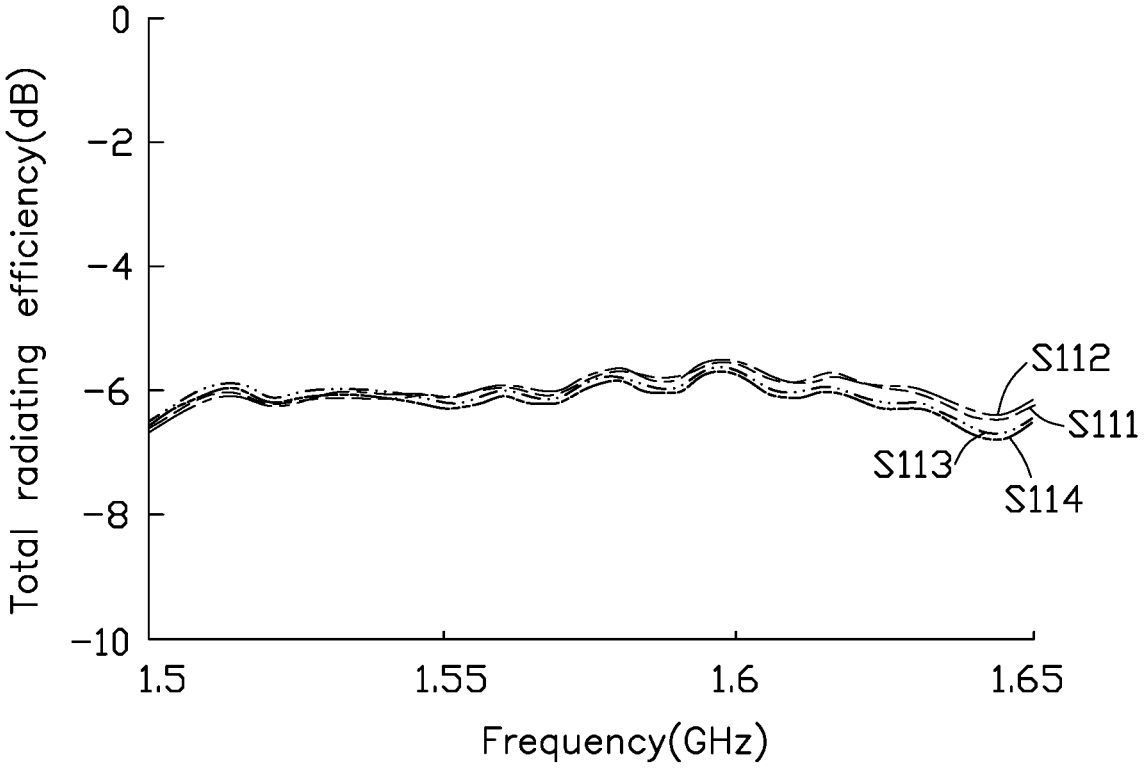
FIG. 11 is a graph of total radiation efficiency of the GPS frequency mode.

FIG. 11 shows a graph of total radiation efficiency of the GPS frequency mode. A plotline S111 represents total radiation efficiency of the GPS band when the antenna structure 100 operates at LTE-A Band17 (704-746 MHz). A plotline S112 represents total radiation efficiency of the GPS band when the antenna structure 100 operates at LTE-A Band13 (746-787 MHz). A plotline S113 represents total radiation efficiency of the GPS band when the antenna structure 100 operates at LTE-A Band20 (791-862 MHz). A plotline S114 represents total radiation efficiency of the GPS band when the antenna structure 100 operates at LTE-A Band8 (880-960 MHz).

As shown in FIGS. 8-11, the first feed source F1, the first radiating portion A1, and the third radiating portion A3 excite the LTE-A low, mid, and high-frequency modes. The switching circuit 17 switches the bandwidth of the LTE-A low-frequency mode to LTE-A Band17 (704-746 MHz), LTE-A Band13 (746-787 MHz), LTE-A Band20 (791-862 MHz), or LTE-A Band8 (880-960 MHz). The second feed source F2 and the second radiating portion A2 excite the GPS mode. The third feed source F3 and the radiating body 15 excite the WIFI 2.4 GHz and the WIFI 5 GHz mode.

Furthermore, when the antenna structure 100 operates in the LTE-A low-frequency mode LTE-A Band17 (704-746 MHz), LTE-A Band13 (746-787 MHz), LTE-A Band20 (791-862 MHz), or LTE-A Band8 (880-960 MHz), the LTE-A mid-high-frequency mode, the GPS band, the WIFI 2.4 GHz band, and the WIFI 5 GHz band are not affected. Thus, the switching circuit 17 only adjusts the low-frequency modes to achieve carrier aggregation requirements of LTE-A.

Figure 12:
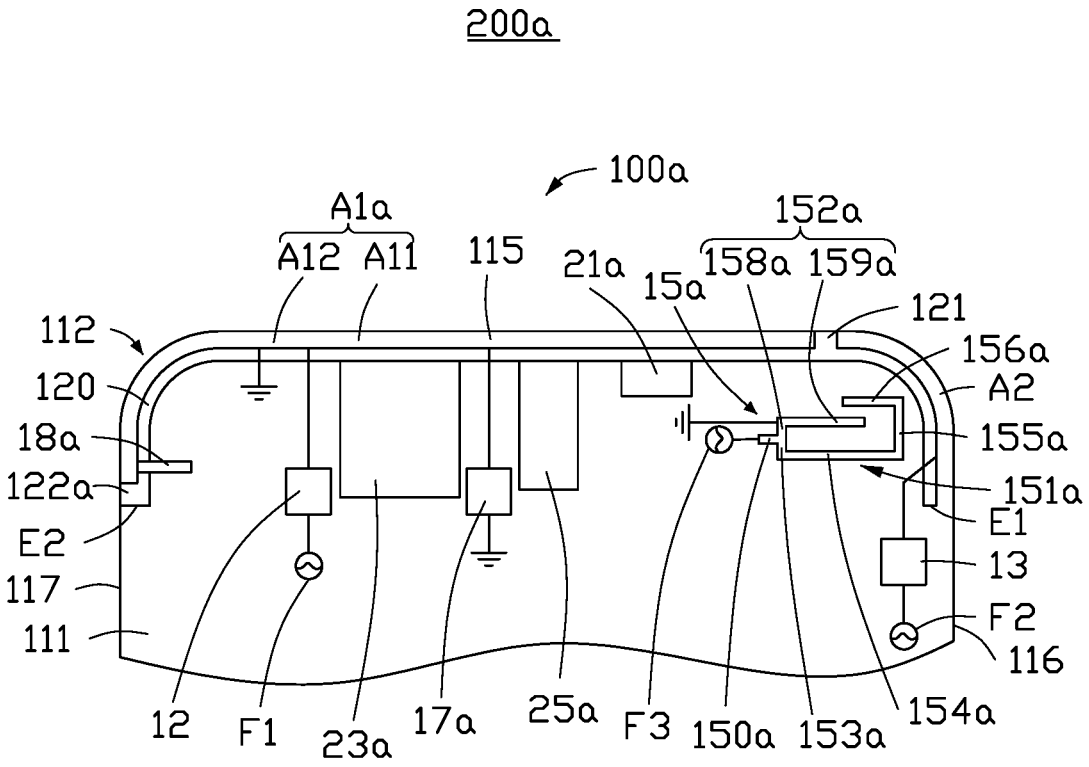
FIG. 12 is a diagram of a second embodiment of an antenna structure.

FIG. 12 shows a second embodiment of an antenna structure 100*a* for use in a wireless communication device 200*a*.

The antenna structure 100*a* includes a middle frame 111, a border frame 112, a first feed source F1*a*, a first matching circuit 12*a*, a second feed source F2, a second matching circuit 13, a short circuit portion 15*a*, and a switching circuit 17*a*. The wireless communication device 200*a* includes a first electronic component 21*a*, a second electronic component 23*a*, and a third electronic component 25*a*.

The border frame 112 includes a slot 120, a first gap 121, and a second gap 122*a*.

In one embodiment, a difference between the antenna structure 100*a* and the antenna structure 100 is that a location of the second gap 122*a* is different. The second gap 122*a* is located at the second endpoint E2 of the second side portion 117. Thus, the slot 120, the first gap 121, and the second gap 122*a* divide the housing 11 into a first radiating portion A1*a* and a second radiating portion A2. In one embodiment, the first radiating portion A1*a* is a portion of the border frame 112 located between the first gap 121 and the second gap 122*a*. The second radiating portion A2 is a portion of the border frame 112 located between the first gap 121 and the first endpoint E1.

The first feed source F1 is electrically coupled to a portion of the first radiating portion A1*a* through the first matching circuit 12 adjacent to the second gap 122*a* to divide the first radiating portion A1*a* into a first radiating section A11 and a second radiating section A12. The first radiating section A11 is a portion of the border frame 112 between the first feed source F1 and the first endpoint 121. The second radiating section A12 is a portion of the border frame 112 between the first feed source F1 and the second gap 122*a*. The second radiating section A12 is coupled to ground. A length of the first radiating section A11 is greater than a length of the second radiating section A12.

The second feed source F2 and the second matching circuit 13 are mounted in the accommodating space 114. One end of the second feed source F2 is electrically coupled to a portion of the second radiating portion A2 adjacent to the first endpoint E1 through the second matching circuit 13 for providing current signals to the second radiating portion A2. The second matching circuit 13 enhances a matching impedance between the second feed source F2 and the second radiating portion A2.

One difference between the antenna structure 100*a* and the antenna structure 100 is that in the antenna structure 100*a*, locations of the first electronic component 21*a*, the second electronic component 23*a*, and the third electronic component 25*a* are different. Specifically, the first electronic component 21*a* may be a proximity sensor located within the accommodating space 114. The first electronic component 21*a* is adjacent to the first gap 121 and is insulated from the first radiating portion A1 by the slot 120.

The second electronic component 23*a* may be a front camera located between the first electronic component 21*a* and the first feed source F1 and is adjacent to the first feed source F1. The second electronic component 23*a* is insulated from the first radiating portion A1 by the slot 120. The third electronic component 25*a* may be a microphone located between the first electronic component 21*a* and the second electronic component 23*a*. In one embodiment, the third electronic component 25*a* is insulated from the first radiating portion A1 by the slot 120.

Another difference between the antenna structure 100*a* and the antenna structure 100 is that in the antenna structure 100*a*, a structure of a radiating body 15*a* is different. In one embodiment, the radiating body 15*a* is mounted within the accommodating space 114 and is located within a space between the first gap 121 and the first endpoint E1. The radiating body 15*a* has a bent shape and may be a flexible printed circuit board or a laser direct structuring board. The radiating body 15*a* includes a connecting portion 150*a*, a first branch 151*a*, and a second branch 152*a*. The connecting portion 150*a* is substantially strip-shaped and extends parallel to the end portion 115 and extends toward the first side portion 116. The first branch 151*a* has a bent shape and includes a first extending section 153*a*, a second extending section 154*a*, a third extending section 155*a*, and a fourth extending section 156*a* coupled in sequence.

The first extending section 153*a* is substantially strip-shaped. One end of the first extending section 153 is perpendicularly coupled to an end portion of the connecting portion 150*a* away from the second side portion 117, and the first extending section 153*a* extends parallel to the first side portion 116 and extends away from the end portion 115.

The second extending section 154*a* is substantially strip-shaped. One end of the second extending section 154*a* is perpendicularly coupled to an end of the first extending section 153*a* away from the connecting portion 150*a*, and the second extending section 154*a* extends parallel to the connecting portion 150*a* and extends toward the first connecting portion 116.

The third extending section 155*a* is substantially strip-shaped. One end of the third extending section 155*a* is perpendicularly coupled to an end of the second extending section 154*a* away from the first extending section 153*a*, and the third extending section 155*a* extends parallel to the first extending section 153*a* and extends toward the end portion 115.

The fourth extending section 156*a* is substantially strip-shaped. One end of the fourth extending section 156*a* is perpendicularly coupled to an end of the third extending section 153*a* away from the second extending section 154*a*, and the fourth extending section 156*a* extends parallel to the second extending section 154*a* and extends toward the first extending section 153*a*.

In one embodiment, the connecting portion 150*a* is mounted on a same surface as the first extending portion 153*a*, the second extending portion 154*a*, the third extending portion 155*a*, and the fourth extending portion 156*a*. A length of the second extending section 154*a* is longer than a length of the fourth extending section 156*a*. The second extending section 154*a* and the fourth extending section 156*a* are mounted on a same side of the third extending section 155*a* and cooperatively form a U shape with the third extending section 155*a*.

The second branch 152*a* is substantially L-shaped and is coupled to ground. The second branch 152*a* includes a first connecting section 158*a* and a second connecting section 159*a*.

The first connecting section 158*a* is substantially strip-shaped. One end of the first connecting section 158*a* is coupled to a junction of the connecting portion 150*a* and the first extending section 153*a*, and the first connecting section 158*a* extends parallel to the third extending section 155*a* and extends toward the end portion 115.

The second connecting section 159*a* is substantially strip-shaped. One end of the second connecting section 159*a* is coupled to an end of the first extending section 153*a* away from the first extending section 153*a*, and the second connecting section 159*a* extends parallel to the second extending section 154*a* and extends toward the third extending section 155*a*.

In one embodiment, a length of the first connecting section 158*a* is less than a length of the third extending section 155*a*. A length of the second connecting section 159*a* is less than a length of the second extending section 154*a*. Thus, the first connecting section 158*a* and the second connecting section 159*a* are mounted within a U shape formed by the second extending section 154*a*, the third extending section 155*a*, and the fourth extending section 156*a*.

In one embodiment, the third feed source F3 is mounted within the accommodating space 114. The third feed source F3 is electrically coupled to the connecting portion 150*a* for feeding current signals to the connecting portion 150*a*, the first branch 151*a*, and the second branch 152*a*.

Another difference between the antenna structure 100*a* and the antenna structure 100 is that a switching circuit 17*a* is in a different location. The switching circuit 17*a* is mounted between the second electronic component 23*a* and the third electronic component 25*a*. One end of the switching component 17*a* crosses over the slot 120 and is electrically coupled to the first radiating section A11. A second end of the switching circuit 17*a* is coupled to ground.

The antenna structure 100*a* further includes a metal portion 18*a*. The metal portion 18*a* is substantially strip-shaped. In one embodiment, a length of the metal portion 18*a* is 0.7 mm. One end of the metal portion 18*a* is electrically coupled to a portion of the first radiating portion A1*a* adjacent to the second gap 122*a*, and the metal portion 18*a* extends along the end portion 115 and extends toward the first side portion 116.

Figure 13:
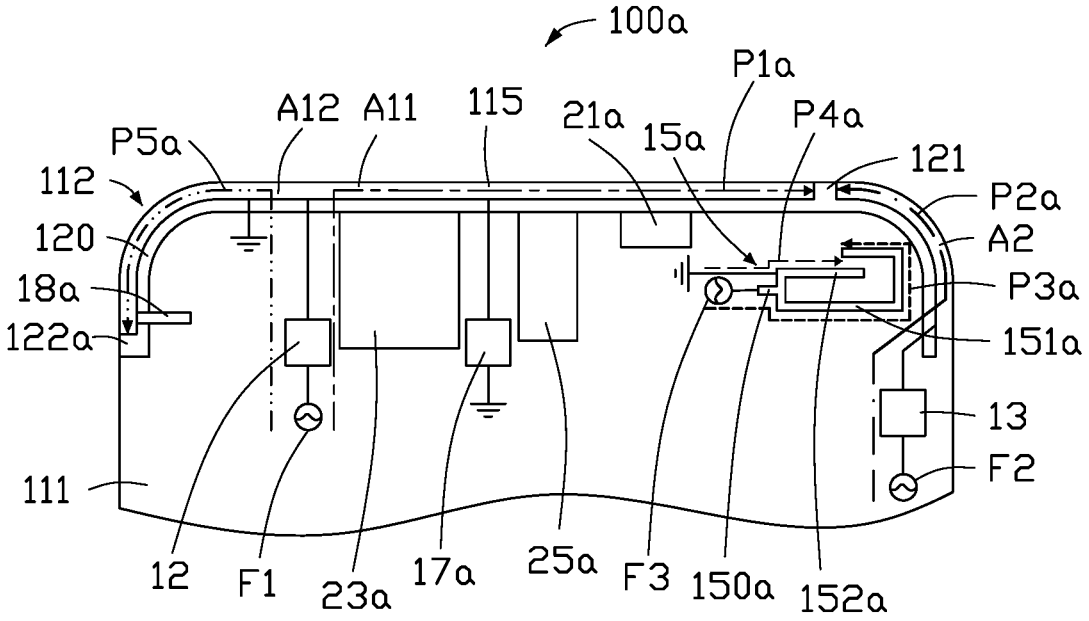
FIG. 13 is a diagram of current paths of the antenna structure in FIG. 12.

As shown in FIG. 13, the first radiating portion A1*a* is a monopole antenna, and the second radiating portion A2 is a monopole antenna. The radiating body 15*a* is a PIFA antenna. Electric current from the first feed source F1 flows along a current path P1*a* through the first matching circuit 12 and the first radiating portion A11 toward the first gap 121 to excite a first resonant mode and generate a radiation signal in a first frequency band.

Electric current from the second feed source F2 flows along a current path P2*a* through the second matching circuit 13 and the second radiating portion A2 toward the first gap 121 to excite a second resonant mode and generate a radiation signal in a second frequency band.

Electric current from the third feed source F3 flows along a current path P3*a* through the connecting portion 150*a* and the first extending portion 153*a*, the second extending portion 154*a*, the third extending portion 155*a*, and the fourth extending portion 156*a* of the first branch 151*a* to excite a third resonant mode and generate a radiation signal in a third frequency band. Simultaneously, electric current from the third feed source F3 flows along a current path P4*a* through the connecting portion 150*a* and the first connecting section 158*a* and the second connecting section 159*a* of the second branch 152*a* to excite a fourth resonant mode and generate a radiation signal in a fourth frequency band.

Electric current from the first feed source F1 also flows along a current path P5*a* through the first matching circuit 12 and the second radiating section A12 toward the second gap 122*a* to excite a fifth resonant mode and generate a radiation signal in a fifth frequency band.

In one embodiment, the first resonant mode is a Long Term Evolution Advanced (LTE-A) low-frequency mode, the second resonant mode is a GPS frequency mode, the third resonant mode is a WIFI 2.4 GHz frequency mode, the fourth resonant mode is a WIFI 5 GHz frequency mode, and the fifth resonant mode is an LTE-A mid-high-frequency mode. The first frequency band is 700-960 MHz. The second frequency band is 1575 MHz. The third frequency band is 2400-2484 MHz. The fourth frequency band is 5150-5850 MHz. The fifth frequency band is 1805-2690 MHz.

The first feed source F1 and the first radiating portion A1*a* cooperatively form a diversity antenna. The second feed source F2 and the second radiating portion A2 cooperatively form a GPS antenna. The third feed source F3 and the radiating body 15*a* cooperatively form a WIFI 2.4 GHz antenna and a WIFI 5 GHz antenna.

The metal portion 18*a* adjusts a frequency of the LTE-A mid-high-frequency mode to a lower frequency.

Figure 14:
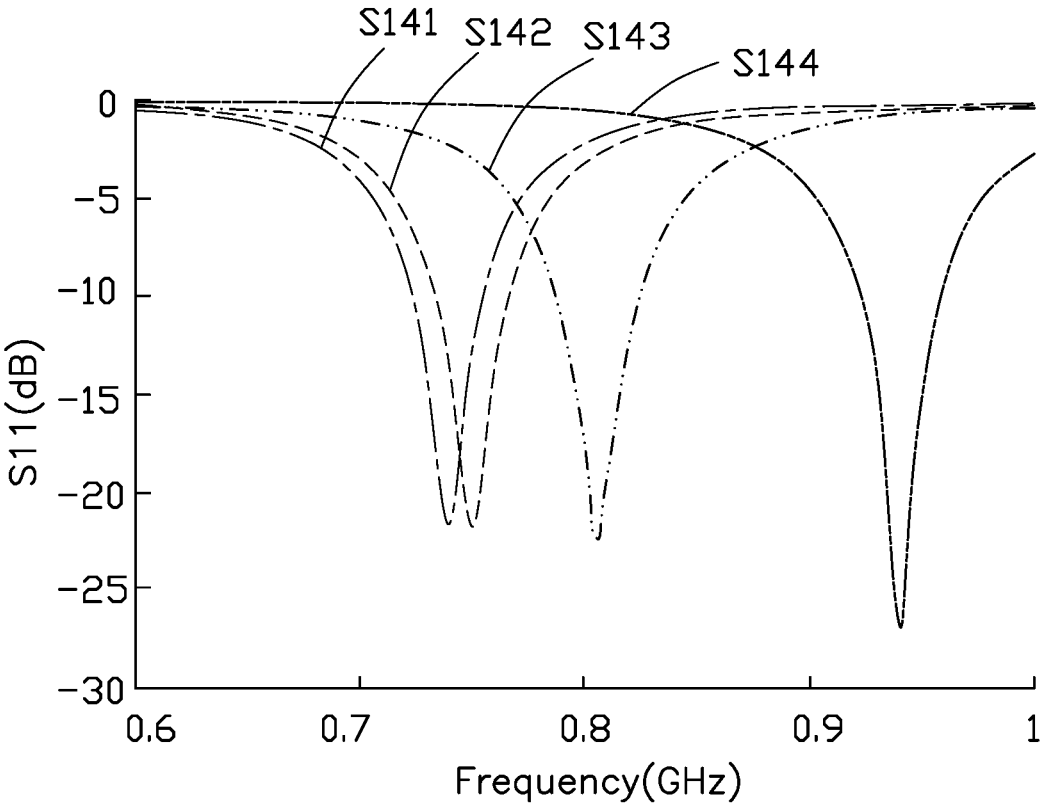
FIG. 14 is a graph of scattering S11 values of the LTE-A low-frequency mode.

FIG. 14 shows a graph of scattering values (S11 values) of the LTE-A low-frequency mode. A plotline S1411 represents S11 values of LTE-A Band17 (704-746 MHz). A plotline S142 represents S11 values of LTE-A Band13 (746-787 MHz). A plotline S143 represents S11 values of LTE-A Band20 (791-862 MHz). A plotline S144 represents S11 values of LTE-A Band8 (880-960 MHz).

Figure 15:
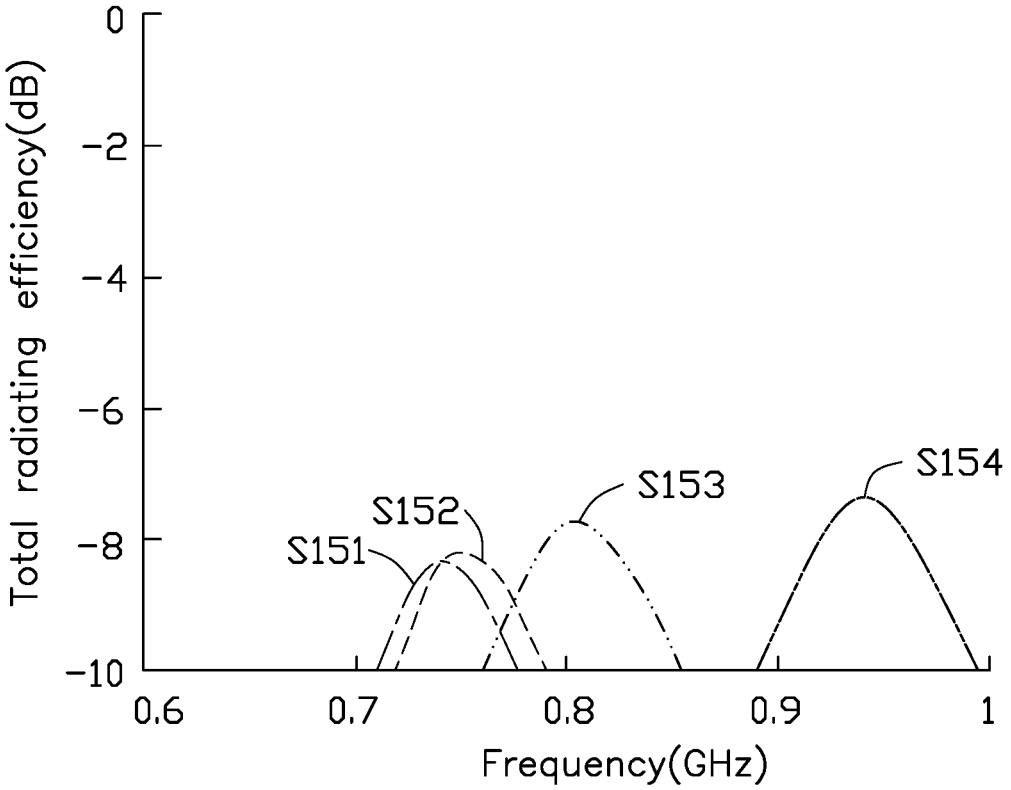
FIG. 15 is a graph of total radiation efficiency of the LTE-A low-frequency mode.

FIG. 15 shows a graph of total radiation efficiency of the LTE-A low-frequency mode. A plotline S151 represents total radiation efficiency when the antenna structure 100 operates in LTE-A Band17 (704-746 MHz). A plotline S152 represents total radiation efficiency when the antenna structure 100 operates in LTE-A Band13 (746-787 MHz). A plotline S153 represents total radiation efficiency when the antenna structure 100 operates in LTE-A Band20 (791-862 MHz). A plotline S154 represents total radiation efficiency when the antenna structure 100 operates in LTE-A Band8 (880-960 MHz).

Figure 16:
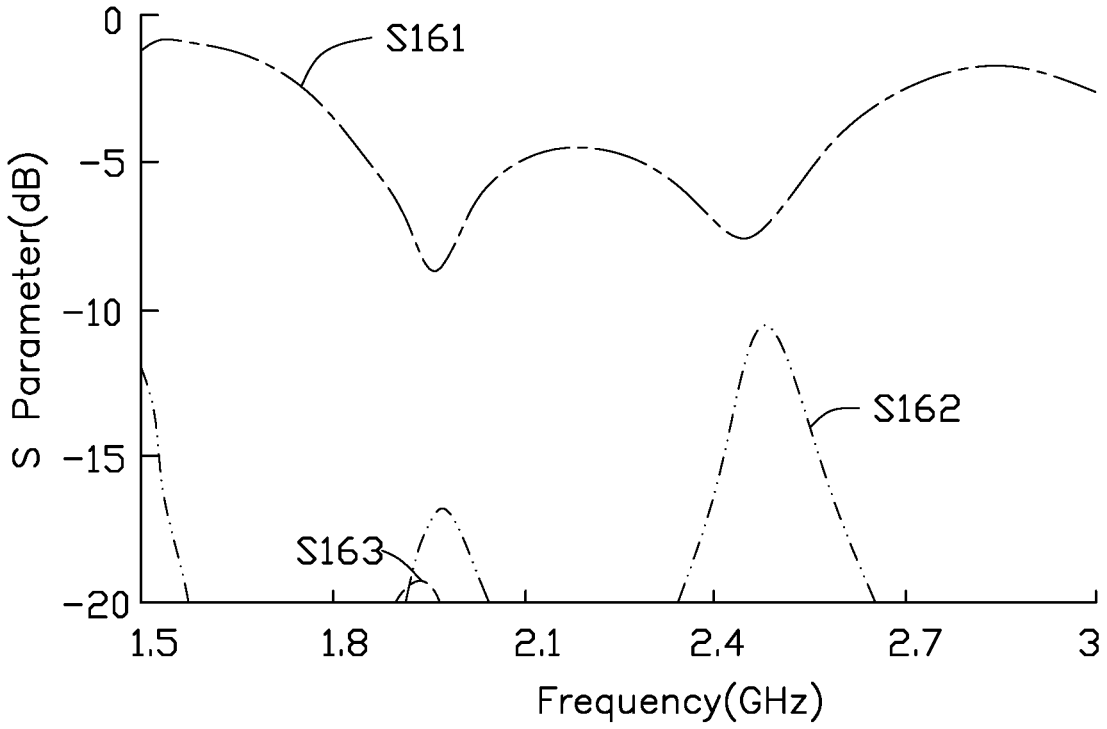
FIG. 16 is a graph of S parameters of the LTE-A mid-high-frequency mode.

FIG. 16 shows a graph of S parameters of the LTE-A mid-high-frequency mode. A plotline S161 represents return loss when the antenna structure 100*a* operates in the LTE-A mid-high-frequency mode. A plotline S162 represents an isolation degree between the second radiation section A12 and the second radiation portion A2 when the antenna structure 100*a* operates in the LTE-A mid-high-frequency mode. A plotline S163 represents an isolation degree between the second radiating section A12 and the radiating body 15*a* when the antenna structure 100*a* operates in the LTE-A mid-high-frequency mode.

Figure 17:
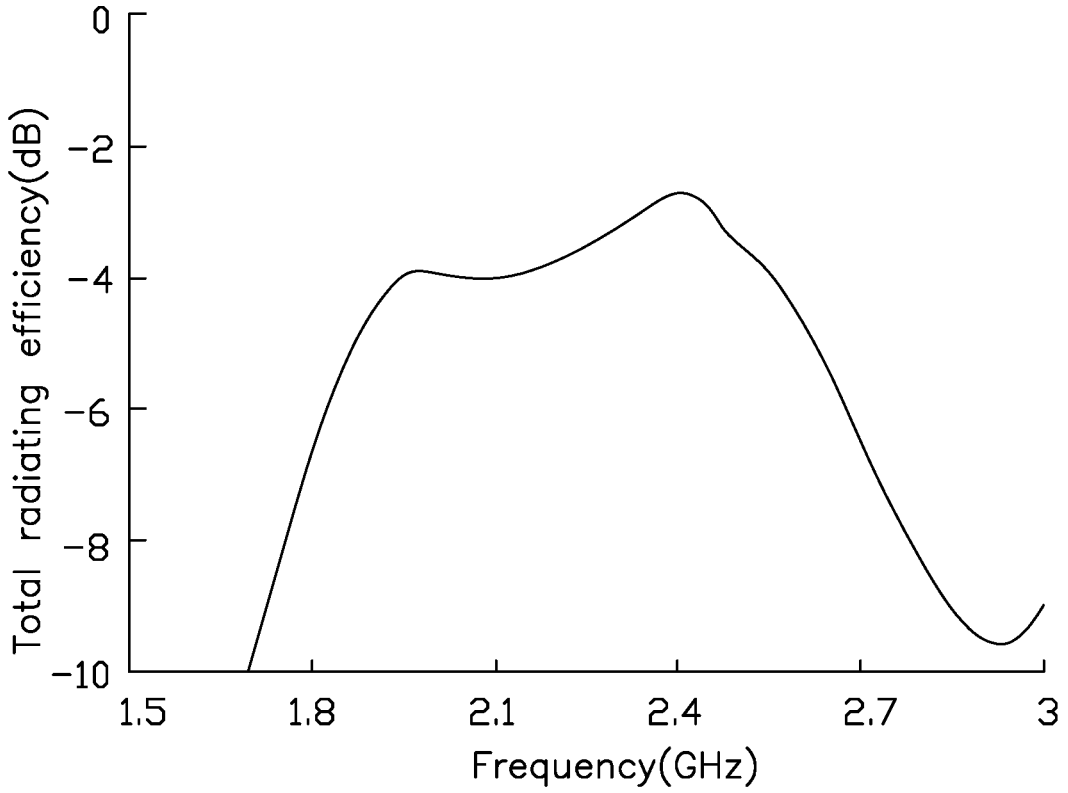
FIG. 17 is a graph of total radiation efficiency of the LTE-A mid-high-frequency mode.

FIG. 17 shows a graph of total radiation efficiency of the LTE-A mid-high-frequency mode.

Figure 18:
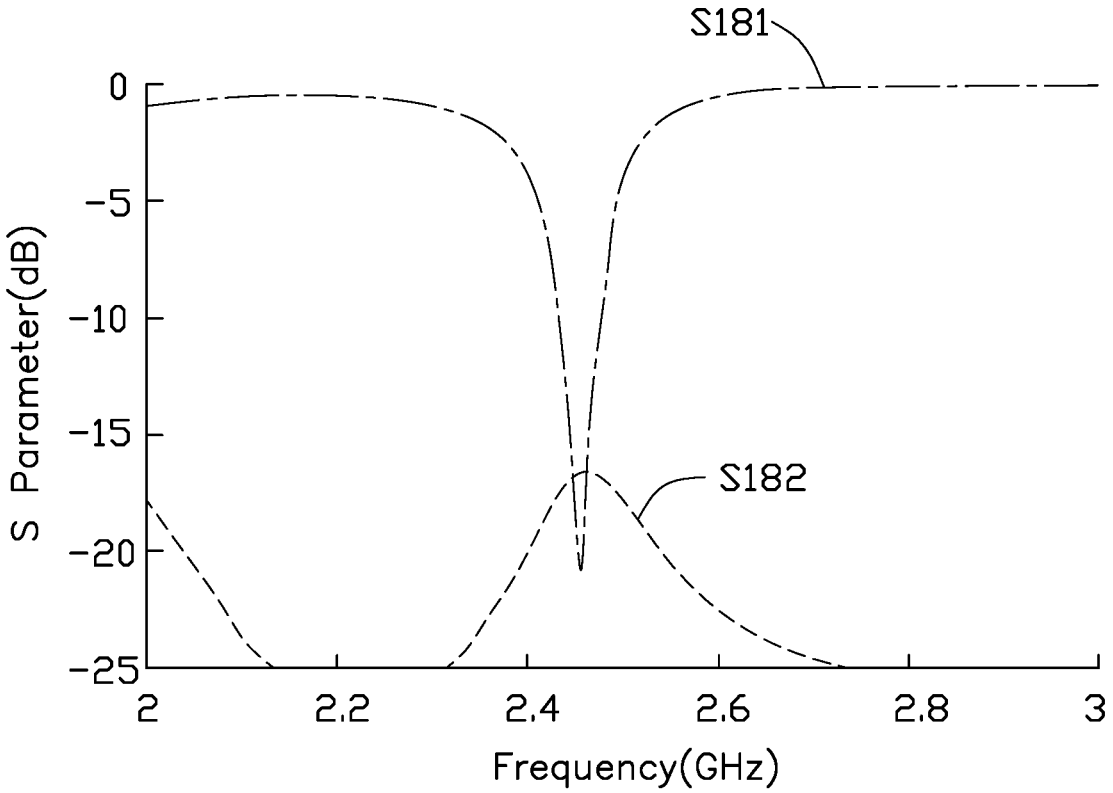
FIG. 18 is a graph of S parameters of the WIFI 2.4 GHz band.

FIG. 18 shows a graph of S parameters of the WIFI 2.4 GHz band. A plotline S181 represents return loss when the antenna structure 100*a* operates in the WIFI 2.4 GHz band. A plotline S182 represents an isolation degree between the radiating body 15*a* and the first radiating portion A1*a* when the antenna structure 100*a* operates in the WIFI 2.4 GHz band.

Figure 19:
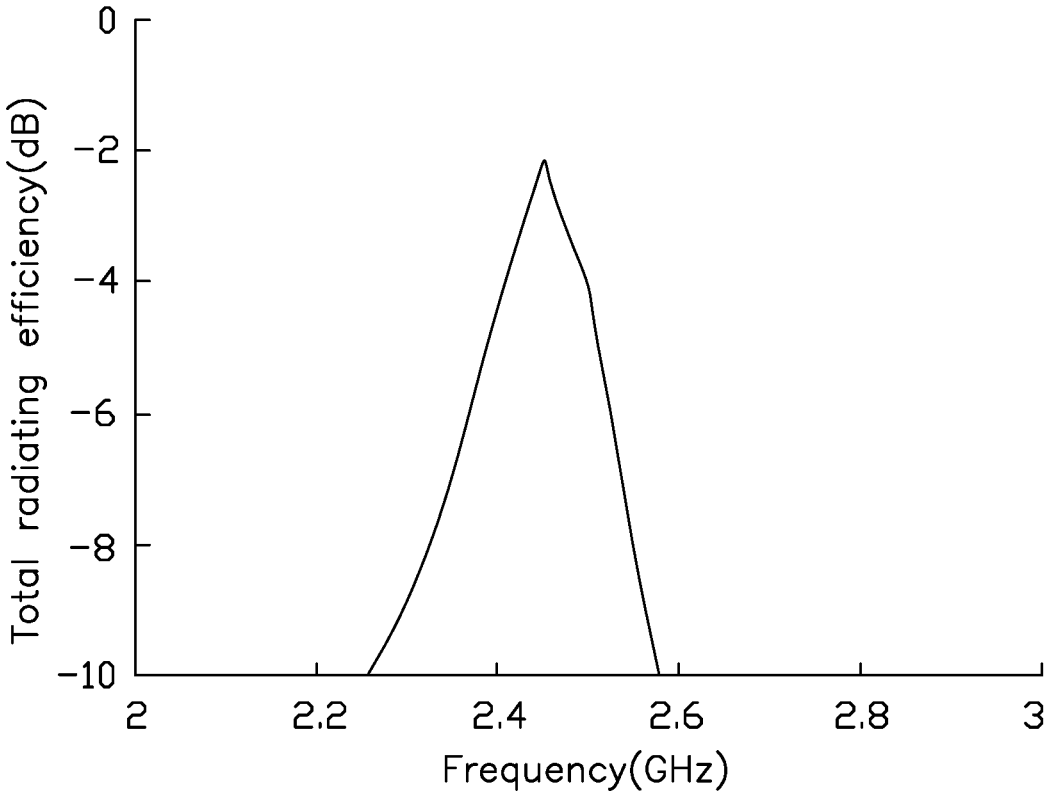
FIG. 19 is a graph of total radiation efficiency of the WIFI 2.4 GHz band.

FIG. 19 shows a graph of total radiation efficiency of the WIFI 2.4 GHz band.

Figure 20:
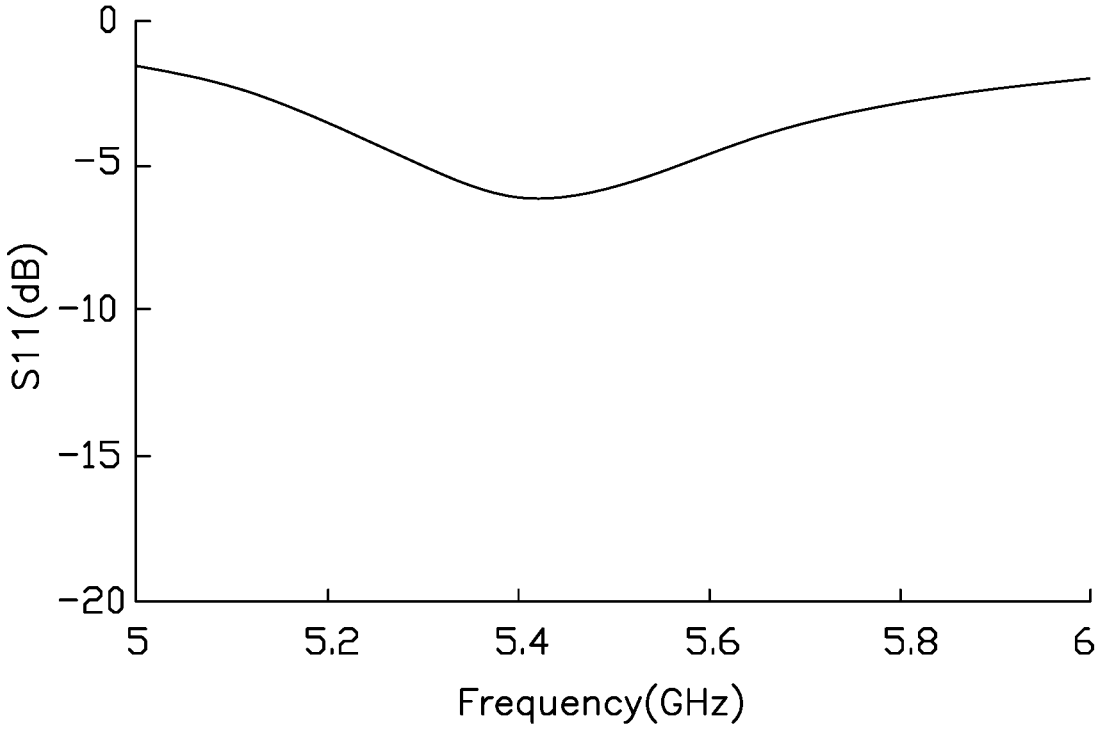
FIG. 20 is a graph of scattering S11 values of the WIFI 5 GHz band.

FIG. 20 shows a graph of scattering S11 values (S11) of the WIFI 5 GHz band.

Figure 21:
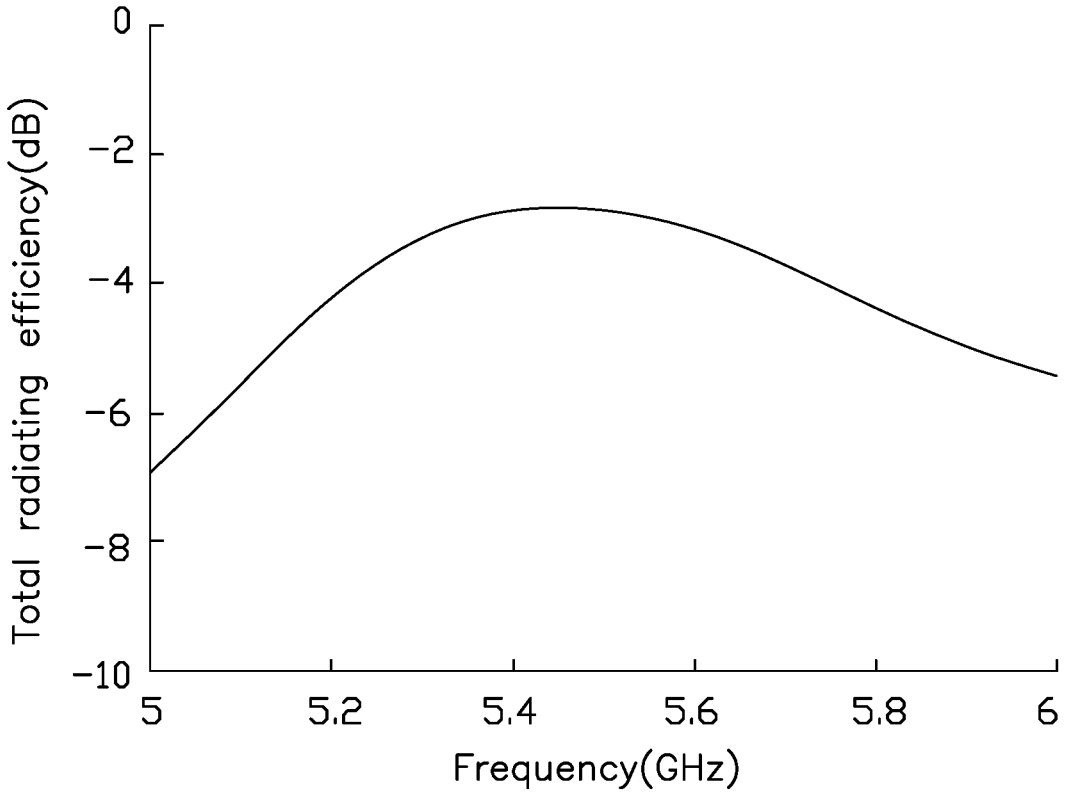
FIG. 21 is a graph of total radiation efficiency of the WIFI 5 GHz band.

FIG. 21 shows a graph of total radiation efficiency of the WIFI 5 GHz band.

Figure 22:
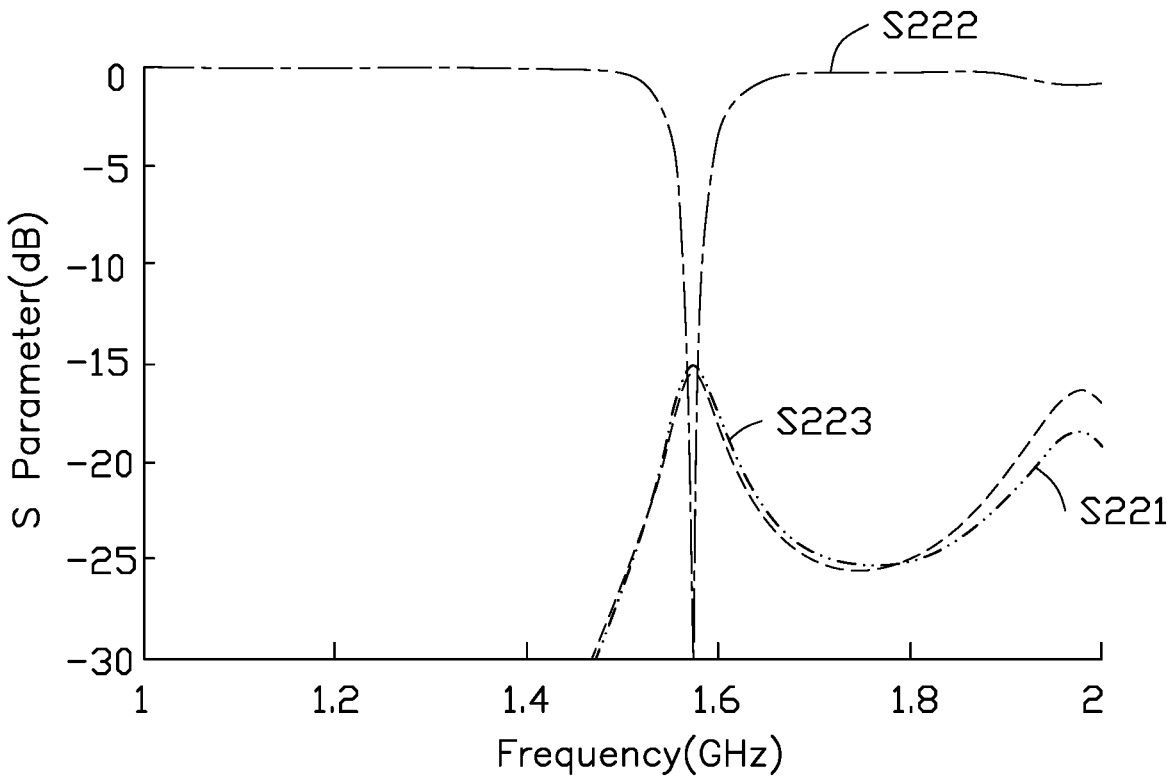
FIG. 22 is a graph of S parameters of the GPS band.

FIG. 22 shows a graph of S parameters of the GPS band. A plotline S221 represents return loss when the antenna structure 100*a* operates in the GPS band. A plotline S222 represents an isolation degree between the second radiating portion A2 and the radiating body 15*a* when the antenna structure 100*a* operates in the GPS band.

Figure 23:
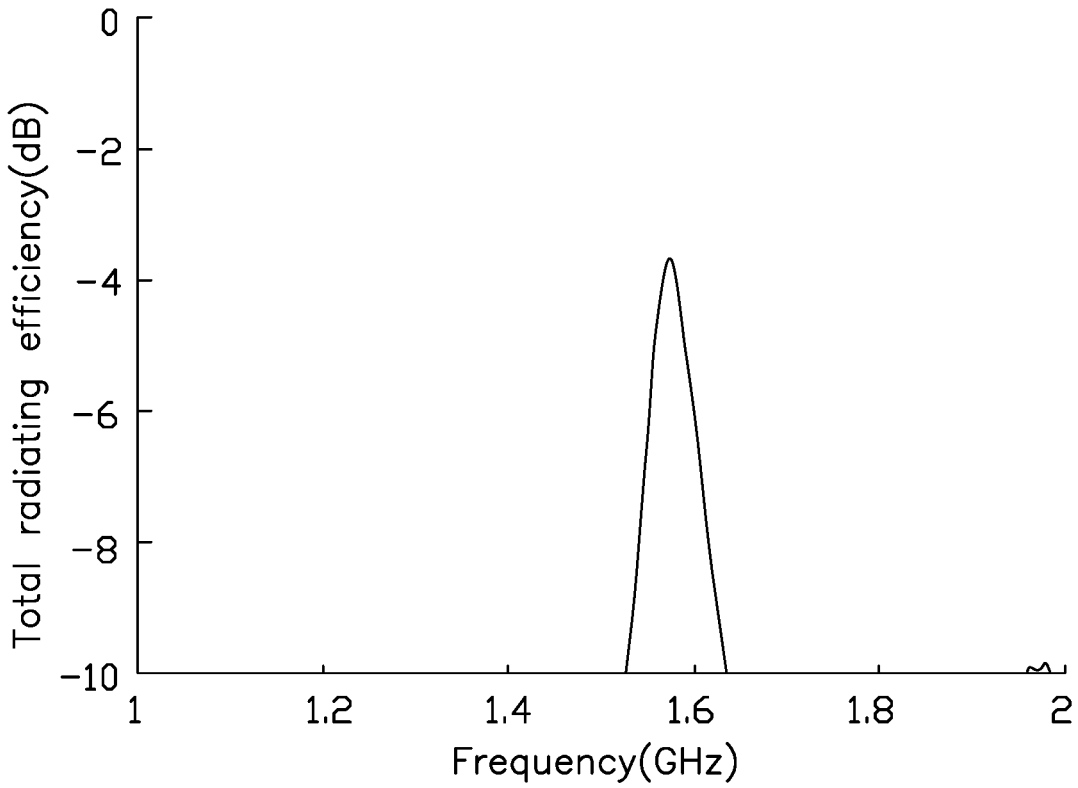
FIG. 23 is a graph of total radiation efficiency of the GPS band.

FIG. 23 shows a graph of total radiation efficiency of the GPS band.

As shown in FIGS. 14-22, the first feed source F1 and the first radiating portion A1 excite the LTE-A low, mid, and high-frequency modes. The switching circuit 17*a* switches the bandwidth of the LTE-A low-frequency mode to LTE-A Band17 (704-746 MHz), LTE-A Band13 (746-787 MHz), LTE-A Band20 (791-862 MHz), or LTE-A Band8 (880-960 MHz). The second feed source F2 and the second radiating portion A2 excite the GPS mode. The third feed source F3 and the radiating body 15*a* excite the WIFI 2.4 GHz and the WIFI 5 GHz mode.

Furthermore, when the antenna structure 100 operates in the LTE-A low-frequency mode LTE-A Band17 (704-746 MHz), LTE-A Band13 (746-787 MHz), LTE-A Band20 (791-862 MHz), or LTE-A Band8 (880-960 MHz), the LTE-A mid-high-frequency mode, the GPS band, the WIFI 2.4 GHz band, and the WIFI 5 GHz band are not affected. Thus, the switching circuit 17*a* only adjusts the low-frequency modes to achieve carrier aggregation requirements of LTE-A.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An antenna structure comprising:

a housing comprising a middle frame, a backplane, and a border frame, wherein the middle frame and the border frame are made of metal, the border frame is mounted around a periphery of the backplane and forms an accommodating space with the backplane and the middle frame, the border frame comprises a slot, a first gap, and a second gap, the slot is in an inner side of the border frame, a width of a portion of the border frame defining the slot is less than a width of other portion of the boarder frame without the slot; the first gap and the second gap are in the border frame, the slot, the first gap, and the second gap divide the border frame into at least a first radiating portion and a second radiating portion;

a first feed source electrically coupled to the first radiating portion and adapted to provide an electric current to the first radiating portion;

a second feed source electrically coupled to the second radiating portion and adapted to provide an electric current to the second radiating portion;

a radiating body mounted within the housing; and a third feed source electrically coupled to the radiating body and adapted to provide an electric current to the radiating body; wherein:

a thickness of the border frame is greater than or equal to twice a width of the first gap or twice a width of the second gap; and a width of the slot is less than or equal to half the width of the first gap and half the width of the second gap.

2. The antenna structure of claim 1, wherein:

the border frame comprises an end portion, a first side portion, and a second side portion;

the first side portion and the second side portion are respectively coupled to opposite ends of the end portion;

the slot is in an inner side of the end portion and extends toward the first side portion and the second side portion;

the first gap is in the end portion and is adjacent to the first side portion;

the first radiating portion is a portion of the border frame between the first gap and the second gap;

the second radiating portion is a portion of the border frame between the first gap and a first endpoint of the first side portion;

a portion of the border frame between the first feed source and the first gap defines a first radiating section;

when the first feed source supplied electric current, the electric current from the first feed source flows through the first radiating section to excite a first resonant mode and generate a radiating signal in a first frequency band;

when the second feed source supplies electric current, the electric current from the second feed source flows through the second radiating portion toward the first gap to excite a second resonant mode and generate a radiation signal in a second frequency band;

when the third feed source supplied electric current, the electric current from the third feed source flows through the radiating body to excite a third resonant mode and generate a radiation signal in a third frequency band and excite a fourth resonant mode and generate a radiation signal in a fourth frequency band.

3. The antenna structure of claim 2, wherein:

the first resonant mode is a Long Term Evolution Advanced (LTE-A) low-frequency mode;

the second resonant mode is a GPS frequency mode;

the third resonant mode is a WIFI 2.4 GHz frequency mode; and the fourth resonant mode is a WIFI 5 GHz frequency mode.

4. The antenna structure of claim 2, wherein:

the radiating body comprises a connecting portion, a first branch, and a second branch;

each of the first branch and the second branch is coupled to the connecting portion;

the third feed source is electrically coupled to the connecting portion;

electric current from the third feed source flows through the connecting portion and the first branch to excite the third resonant mode;

electric current from the third feed source flows through the connecting portion and the second branch to excite the fourth resonant mode.

5. The antenna structure of claim 4, wherein:

the first branch comprises a first extending section, a second extending section, a third extending section, a fourth extending section, and a fifth extending section coupled in sequence;

one end of the first extending section is perpendicularly coupled to an end portion of the connecting portion, and the first extending section extends parallel to the end portion and extends toward the second side portion;

one end of the second extending section is perpendicularly coupled to an end of the first extending section away from the connecting portion, and the second extending section extends parallel to the first side portion and extends toward the end portion;

one end of the third extending section is perpendicularly coupled to an end of the second extending section away from the first extending section, and the third extending section extends parallel to the first extending section and extends toward the second side portion;

one end of the fourth extending section is perpendicularly coupled to an end of the third extending section away from the second extending section, and the fourth extending section extends parallel to the second extending section and extends away from the end portion;

one end of the fifth extending section is perpendicularly coupled to an end of the fourth extending section away from the third extending section, and the fifth extending section extends parallel to the first extending section and extends toward the second extending section;

the second branch comprises a first connecting section and a second connecting section;

one end of the first connecting section is coupled to a junction of the connecting portion and the first extending section, and the first connecting section extends parallel to the second extending section and extends toward the end portion;

one end of the second connecting section is coupled to an end of the first extending section away from the first extending section, and the second connecting section extends parallel to the first extending section and extends away from the third extending section.

6. The antenna structure of claim 4, wherein:

the first branch comprises a first extending section, a second extending section, a third extending section, and a fourth extending section coupled in sequence;

one end of the first extending section is perpendicularly coupled to an end portion of the connecting portion away from the second side portion, and the first extending section extends parallel to the first side portion and extends away from the end portion;

one end of the second extending section is perpendicularly coupled to an end of the first extending section away from the connecting portion, and the second extending section extends parallel to the connecting portion and extends toward the first connecting portion;

one end of the third extending section is perpendicularly coupled to an end of the second extending section away from the first extending section, and the third extending section extends parallel to the first extending section and extends toward the end portion;

one end of the fourth extending section is perpendicularly coupled to an end of the third extending section away from the second extending section, and the fourth extending section extends parallel to the second extending section and extends toward the first extending section;

the second branch comprises a first connecting section and a second connecting section;

one end of the first connecting section is coupled to a junction of the connecting portion and the first extending section, and the first connecting section extends parallel to the third extending section and extends toward the end portion;

one end of the second connecting section is coupled to an end of the first extending section away from the first extending section, and the second connecting section extends parallel to the second extending section and extends toward the third extending section.

7. The antenna structure of claim 2 further comprising a switching circuit, wherein:

the switching circuit comprises a switching unit and a plurality of switching components;

the switching unit is electrically coupled to the first radiating section;

the plurality of switching components are coupled together in parallel;

one end of each of the plurality of switching components is electrically coupled to the switching unit, and a second end of each of the plurality of switching components is coupled to ground;

the switching unit controls the first radiating section to electrically couple to each of the switching components or combinations of the switching components thereby adjusting a frequency of the first frequency band.

8. The antenna structure of claim 2, wherein:

the second gap is defined in the end portion and is adjacent to the second side portion;

a portion of the border frame between the first feed source and the second gap defines a second radiating section;

a third radiating portion is defined in a portion of the border frame between the second gap and a second endpoint of the second side portion;

electric current from the first feed source flows through the second radiating section and coupled to the third radiating portion through the second gap to excite a fifth resonant mode and generate a radiation signal in a fifth frequency band.

9. The antenna structure of claim 8, wherein:

the fifth resonant mode is an LTE-A mid-high-frequency mode.

10. The antenna structure of claim 2, wherein:

the second gap is in the second side portion at a second endpoint of the second side portion;

a portion of the border frame between the first feed source and the second gap defines a second radiating section;

electric current from the first feed source flows through the second radiating section toward the second gap to excite a fifth resonant mode and generate a radiation signal in a fifth frequency band.

11. The antenna structure of claim 10, wherein:

the fifth resonant mode is an LTE-A mid-high-frequency mode.

12. The antenna structure of claim 11 further comprising a metal portion, wherein:

an end of the metal portion is electrically coupled to a portion of the first radiating portion adjacent to the second gap, and the metal portion extends parallel to the end portion and extends toward the first side portion; and the metal portion adjusts a frequency of the LTE-A mid-high frequency mode.

13. The antenna structure of claim 1, wherein the middle frame and the border frame are integrally formed.

14. A wireless communication device comprising an antenna structure comprising:

a housing comprising a middle frame, a backplane, and a border frame, wherein the middle frame and the border frame are made of metal, the border frame is mounted around a periphery of the backplane and forms an accommodating space with the backplane and the middle frame, the border frame comprises a slot, a first gap, and a second gap, the slot is in an inner side of the border frame, a width of a portion of the border frame defining the slot is less than a width of other portion of the boarder frame without the slot; the first gap and the second gap are in the border frame, the slot, the first gap, and the second gap divide the border frame into at least a first radiating portion and a second radiating portion;

a first feed source electrically coupled to the first radiating portion and adapted to provide an electric current to the first radiating portion;

a second feed source electrically coupled to the second radiating portion and adapted to provide an electric current to the second radiating portion;

a radiating body mounted within the housing; and a third feed source electrically coupled to the radiating body and adapted to provide an electric current to the radiating body; wherein:

a thickness of the border frame is greater than or equal to twice a width of the first gap or twice a width of the second gap; and a width of the slot is less than or equal to half the width of the first gap and half the width of the second gap.

15. The wireless communication device of claim 14, wherein:

the border frame comprises an end portion, a first side portion, and a second side portion;

the first side portion and the second side portion are respectively coupled to opposite ends of the end portion;

the slot is in an inner side of the end portion and extends toward the first side portion and the second side portion;

the first gap is in the end portion and is adjacent to the first side portion;

the first radiating portion is a portion of the border frame between the first gap and the second gap;

the second radiating portion is a portion of the border frame between the first gap and a first endpoint of the first side portion;

a portion of the border frame between the first feed source and the first gap defines a first radiating section;

when the first feed source supplies electric current, the electric current from the first feed source flows through the first radiating section to excite a first resonant mode and generate a radiating signal in a first frequency band;

when the second feed source supplies electric current, the electric current from the second feed source flows through the second radiating portion toward the first gap to excite a second resonant mode and generate a radiation signal in a second frequency band;

when the third feed source supplies electric current, the electric current from the third feed source flows through the radiating body to excite a third resonant mode and generate a radiation signal in a third frequency band and excite a fourth resonant mode and generate a radiation signal in a fourth frequency band.

16. The wireless communication device of claim 15, wherein:

the radiating body comprises a connecting portion, a first branch, and a second branch;

each of the first branch and the second branch is coupled to the connecting portion;

the third feed source is electrically coupled to the connecting portion;

electric current from the third feed source flows through the connecting portion and the first branch to excite the third resonant mode;

electric current from the third feed source flows through the connecting portion and the second branch to excite the fourth resonant mode.

17. The wireless communication device of claim 16, wherein:

the first branch comprises a first extending section, a second extending section, a third extending section, a fourth extending section, and a fifth extending section coupled in sequence;

one end of the first extending section is perpendicularly coupled to an end portion of the connecting portion, and the first extending section extends parallel to the end portion and extends toward the second side portion;

one end of the second extending section is perpendicularly coupled to an end of the first extending section away from the connecting portion, and the second extending section extends parallel to the first side portion and extends toward the end portion;

one end of the third extending section is perpendicularly coupled to an end of the second extending section away from the first extending section, and the third extending section extends parallel to the first extending section and extends toward the second side portion;

one end of the fourth extending section is perpendicularly coupled to an end of the third extending section away from the second extending section, and the fourth extending section extends parallel to the second extending section and extends away from the end portion;

one end of the fifth extending section is perpendicularly coupled to an end of the fourth extending section away from the third extending section, and the fifth extending section extends parallel to the first extending section and extends toward the second extending section;

the second branch comprises a first connecting section and a second connecting section;

one end of the first connecting section is coupled to a junction of the connecting portion and the first extending section, and the first connecting section extends parallel to the second extending section and extends toward the end portion;

one end of the second connecting section is coupled to an end of the first extending section away from the first extending section, and the second connecting section extends parallel to the first extending section and extends away from the third extending section.

18. The wireless communication device of claim 16, wherein:

the first branch comprises a first extending section, a second extending section, a third extending section, and a fourth extending section coupled in sequence;

one end of the first extending section is perpendicularly coupled to an end portion of the connecting portion away from the second side portion, and the first extending section extends parallel to the first side portion and extends away from the end portion;

one end of the second extending section is perpendicularly coupled to an end of the first extending section away from the connecting portion, and the second extending section extends parallel to the connecting portion and extends toward the first connecting portion;

one end of the third extending section is perpendicularly coupled to an end of the second extending section away from the first extending section, and the third extending section extends parallel to the first extending section and extends toward the end portion;

one end of the fourth extending section is perpendicularly coupled to an end of the third extending section away from the second extending section, and the fourth extending section extends parallel to the second extending section and extends toward the first extending section;

the second branch comprises a first connecting section and a second connecting section;

one end of the first connecting section is coupled to a junction of the connecting portion and the first extending section, and the first connecting section extends parallel to the third extending section and extends toward the end portion;

one end of the second connecting section is coupled to an end of the first extending section away from the first extending section, and the second connecting section extends parallel to the second extending section and extends toward the third extending section.

19. The wireless communication device of claim 15, wherein:

the second gap is defined in the end portion and is adjacent to the second side portion;

a portion of the border frame between the first feed source and the second gap defines a second radiating section;

a third radiating portion is defined in a portion of the border frame between the second gap and a second endpoint of the second side portion;

electric current from the first feed source flows through the second radiating section and coupled to the third radiating portion through the second gap to excite a fifth resonant mode and generate a radiation signal in a fifth frequency band.

20. The wireless communication device of claim 15, wherein:

the second gap is in the second side portion at a second endpoint of the second side portion;

a portion of the border frame between the first feed source and the second gap defines a second radiating section;

electric current from the first feed source flows through the second radiating section toward the second gap to excite a fifth resonant mode and generate a radiation signal in a fifth frequency band.

* * * * *